US009127369B2

(12) United States Patent
Al-Mubasher

(10) Patent No.: US 9,127,369 B2
(45) Date of Patent: Sep. 8, 2015

(54) SYSTEM, APPARATUS, AND METHOD FOR UTILIZATION OF BRACELET GALVANIC ANODES TO PROTECT SUBTERRANEAN WELL CASING SECTIONS SHIELDED BY CEMENT AT A CELLAR AREA

(71) Applicant: Saudi Arabian Oil Company, Dhahran (SA)

(72) Inventor: Mohammed H. Al-Mubasher, Dhahran (SA)

(73) Assignee: Saudi Arabian Oil Company (SA)

( * ) Notice: Subject to any disclaimer, the term of this patent is extended or adjusted under 35 U.S.C. 154(b) by 250 days.

(21) Appl. No.: 13/628,621

(22) Filed: Sep. 27, 2012

(65) Prior Publication Data

US 2013/0081955 A1 Apr. 4, 2013

Related U.S. Application Data

(60) Provisional application No. 61/540,849, filed on Sep. 29, 2011.

(51) Int. Cl.
*C23F 13/00* (2006.01)
*C23F 13/16* (2006.01)
(Continued)

(52) U.S. Cl.
CPC ..... *C23F 13/16* (2013.01); *C23F 13/06* (2013.01); *C23F 13/10* (2013.01); *C23F 13/18* (2013.01);
(Continued)

(58) Field of Classification Search
CPC ..... C23F 13/10; C23F 13/18; C23F 2213/30; C23F 2213/31; C23F 2213/32; C23F 13/02; C23F 13/08; C23F 13/16
USPC ..... 204/196.3, 196.31, 196.36, 196.01; 205/724
See application file for complete search history.

(56) References Cited

U.S. PATENT DOCUMENTS 2,829,099 A 4/1958 Marsh
3,623,968 A * 11/1971 Bohne ..... 204/196.15
(Continued)

FOREIGN PATENT DOCUMENTS

GB 2050427 A * 1/1981 ..... 204/196.15
GB 2050427 A 1/1984
WO 03/102268 A1 12/2003

OTHER PUBLICATIONS

PCT International Search Report and the Written Opinion of the International Searching Authority dated Dec. 4, 2013; International Application No. PCT/US2012/057806; International File Date: Sep. 28, 2012.

*Primary Examiner* — Luan Van
*Assistant Examiner* — Alexander W Keeling
(74) *Attorney, Agent, or Firm* — Bracewell & Giuliani LLP; Constance Gall Rhebergen; Linda L. Morgan

(57) ABSTRACT

A cathodic protection system is provided for a subterranean well casing having an enclosed upper section of the well casing being substantially shielded by a cellar from an impressed-current cathodic protection circuit passing through earth media. The impressed-current cathodic protection circuit is provided to protect an unenclosed lower section of the well casing. To protect the enclosed upper section of the well casing, a supplemental cathodic protection circuit is provided. The supplemental cathodic protection circuit is a galvanic anode cathodic protection circuit comprising the enclosed upper section of the well casing and one or more bracelet galvanic anodes being circumferentially mounted to the enclosed upper section. The enclosed upper section of the well casing and the one or more bracelet galvanic anodes are substantially surrounded by a cellar backfill, and the galvanic anode cathodic protection circuit is equally effective throughout a broad range of non-homogeneity within the cellar backfill.

12 Claims, 12 Drawing Sheets

(51) Int. Cl.

| | |
|---|---|
| ***C23F 13/06*** | (2006.01) |
| ***C23F 13/10*** | (2006.01) |
| ***C23F 13/18*** | (2006.01) |
| ***C23F 13/20*** | (2006.01) |
| ***E21B 33/037*** | (2006.01) |

(52) U.S. Cl.
CPC ..... *C23F 13/20* (2013.01); *E21B 33/0375* (2013.01); *C23F 2213/21* (2013.01); *C23F 2213/32* (2013.01)

(56) References Cited

U.S. PATENT DOCUMENTS

| | | | | |
|---|---|---|---|---|
| 4,487,230 | A * | 12/1984 | Anthony | 204/196.16 |
| 5,547,020 | A | 8/1996 | Sable et al. | |
| 5,547,311 | A | 8/1996 | Kenda | |
| 6,250,338 | B1 * | 6/2001 | Dempsey | 138/103 |
| 6,858,117 | B2 | 2/2005 | Berton et al. | |
| 2005/0178673 | A1 | 8/2005 | Al-Mahrous et al. | |
| 2005/0284771 | A1 | 12/2005 | Filho et al. | |

* cited by examiner

SYSTEM, APPARATUS, AND METHOD FOR UTILIZATION OF BRACELET GALVANIC ANODES TO PROTECT SUBTERRANEAN WELL CASING SECTIONS SHIELDED BY CEMENT AT A CELLAR AREA

PRIORITY

This application claims priority to U.S. Provisional Patent Application No. 61/540,849 titled "System, Apparatus, and Method for Utilization of Bracelet Galvanic Anodes to Protect Subterranean Well Casing Sections Shielded by Cement at the Cellar Area," filed on Sep. 29, 2011, the disclosure of which is incorporated herein by reference in its entirety.

BACKGROUND OF THE INVENTION

1. Field of the Invention

This invention relates in general to well production systems for subterranean resources such as oil or water, and in particular to equipment and methods for protection of metallic well casing from the corrosive effects of moist soil the well cellar area.

2. Description of the Related Art

Steel components of well production systems, such as the well casing, that are submerged in a corrosive environment require some form of protection to prevent corrosion. Cathodic protection ("CP") systems, for example, are conventionally used to protect steel components of well production systems from corrosion.

One particular type of CP system is known as a galvanic anode cathodic protection ("GACP") system. In GACP systems, steel structures can be protected from corrosion ("a protected metal") by being positioned as a cathode in an electrochemical cell that includes an anode composed of a more highly reactive metal than the cathode. The anodes can be composed, for example, of highly reactive metals such as aluminum, zinc, or magnesium. The electrochemical cell includes an electrolyte (e.g., water or moist soil), and the anode and the cathode are positioned in the same electrolyte to provide an ion pathway between the anode and the cathode. In the electrochemical cell, the anode and the cathode are also eclectically connected, for example, by a conductive cable, to provide an electron pathway between the anode and the cathode.

When the protected metal and the anode are positioned in the electrochemical cell accordingly, the more reactive anode corrodes in preference to the protected metal structure, thereby preventing corrosion of the protected metal. Due to the difference in the natural potentials between the anode and the protected metal, by their relative positions in the electrochemical cell, when the anode corrodes, high-energy electrons flow from the anode to the cathode through the electrical connection, thereby preventing an oxidation reaction at the protected metal structure. Thus, the anode corrodes instead of the protected metal (the cathode), until the anode material is depleted. The anode in a GACP system is known as a "sacrificial anode," and likewise, GACP systems are also known as "sacrificial anode systems"

GACP systems are conventionally used for the cathodic protection of subsea pipeline due to the high conductivity of seawater and the ease at which galvanic anodes can be placed on the pipeline. On the other hand, GACP systems are not primarily used for cathodic protection of subterranean well casings because of the higher current output necessary to protect large metal structures surrounded by a highly resistive ground electrolyte.

Another type of CP system is known as a impressed-current cathodic protection ("ICCP") system. In many ways, ICCP systems are similar to GACP systems —except that ICCP systems use less reactive anode metals needing to be connected to an external power source to provide greater current output. In the prior art, ICCP systems have been used for the purpose of protecting subterranean well casings in well production systems. Impressed-current cathodic protection systems employ D/C power (e.g., rectified A/C power) to impress a current between one or more external anodes (e.g., positioned in a subterranean anode bed) and the cathode surface (e.g., a well casing). The anode bed and the well casing are both buried in the earth, and are surrounded by a ground electrolyte (e.g., backfill for the anode bed or moist soil for the well casing).

Although ICCP systems are intended to protect the entire length of subterranean pipeline in typical well production systems, ICCP systems often fail, however, to adequately protect certain sections of the well casing, such as those sections that are shielded from the ground electrolyte. In particular, certain sections of the well casing, for example, those sections enclosed by a cellar (such as a circular metallic or non-metallic ring, such as a cement ring, installed at the wellhead base prior to drilling operations to secure the hole during drilling and are left in place during well production operations) at or near the earth surface, for example, are shielded from the ground electrolyte, and thus, are inadequately protected by conventional ICCP systems. Those certain sections of the well casings enclosed by a cellar can be, for example, the upper two meters of the well casing.

One conventional use of GACP for cathodic protection of subterranean well casings has been to provide a supplemental cathodic protection system to a relatively small number of well casing joints or sections at or near the surface of the well casings, leaving the remainder of the well casing to be protected by other means, such as an ICCP system. Accordingly, combined ICCP-and-GACP systems have been used to provide overall protection of the well casing as well as localized protection of the well casing sections in the cellar area. Conventional GACP systems used for this purpose have included standard cylindrical anodes, for example, two pre-packaged 60-lbs. magnesium anodes, positioned within the cellar. Because the relatively low current output of GACP systems compared to ICCP systems, and because of the relatively high level of non-homogenous electrolyte in the cellar area, there are unique disadvantages of using GACP systems in the cellar area. The electrolyte in the cellar area, which is also referred to as the "backfill," can become polluted, for example, with various non-conductive or less conductive substances (herein referred to as "non-homogenous") such as drilling mud, cement, or other foreign particles. A non-homogenous backfill disadvantageously increases the resistance within the electrochemical cell and reduces the effectiveness of the GACP system. A related disadvantage, is that due to increasing non-homogeneity of the backfill, the ongoing effectiveness of the GACP system is reduced over time and, eventually, the backfill must be replaced periodically to restore an adequate level of cathodic protection, which can be both time-consuming and costly, and failure to periodically replace the backfill has resulted in significant corrosion to metal structures in the cellar area, resulting in even more time-consuming and costly repairs of the upper well casing joints. There is a need in the art for improved cathodic protection systems for well casing sections in the cellar area that exhibit greater effectiveness in polluted backfill and reduce or eliminate the need to periodically replace the backfill.

SUMMARY OF THE INVENTION

Applicants recognize the foregoing disadvantages of conventional cathodic protection systems with respect to enclosed sections of well casings in oil and water well production operations. Where cement surrounding the well casing at the cellar area creates a shielding effect that disadvantageously impedes the current of existing ICCP systems, enhanced supplemental cathodic protection systems are needed to more effectively protect the well casing from corrosion in the cellar area. Removal of the cement surrounding the well casing can reduce shielding effects, however, such a process is dangerous, costly, and time consuming. Accordingly, applicants provide an enhanced supplemental cathodic protection system that is more effective than are known uses of conventional GACP systems in the cellar area.

In view of the foregoing disadvantages recognized by Applicant, Applicant herein provides an enhanced cathodic protection system using bracelet galvanic anodes for localized protection of sections of well casing in the cellar area. The enhanced cathodic protection system described herein can more effectively protect the enclosed sections of well casings in the cellar area by overcoming the unique disadvantages of conventional uses of GACP systems in the cellar area. Embodiments of an enhanced cathodic protection system advantageously provide an increased tolerance to non-homogenous backfill, eliminate the need to remove any of the cement surrounding the well casing, and reduce or eliminate the need to periodically replace the backfill within the cellar area. Embodiments of the invention, for example, provide sacrificial anodes having a shape, structure, and configuration that provides decreased anode resistance compared to the conventionally-used cylindrical anodes. According to embodiments of the invention, for example, the shape and structure of the sacrificial anodes allows for a decreased distance between the anode surface and the cathode surface, thereby beneficially decreasing the resistance of the cathodic protection circuit. Also, according to embodiments of the invention, for example, the shape and structure of the sacrificial anodes allows for increased surface area of the anode, thereby beneficially decreasing the resistance of the cathodic protection circuit. Embodiments of the invention further provide an enhanced sacrificial anode assembly that is uniquely suited for existing well-casings in cellar area by allowing for a simpler and safer installation and removal of the sacrificial anode assembly.

An exemplary embodiment of the present invention includes a bracelet anode assembly to provide enhanced cathodic protection to one or more vertical well casing sections in a cellar area, the cellar area being bounded by a cellar ring and being partially filled with an electrolytic composition surrounding the one or more vertical well casing sections, the one or more vertical well casing sections in the cellar area defining a cellar-area well casing.

In such an exemplary embodiment, the bracelet anode assembly includes a plurality of arc-shaped bracelet anodes adapted to circumferentially surround a cylindrical subsection of an outer surface of the cellar-area well casing such that the plurality of arc-shaped bracelet are operable to be mechanically connected in a substantially circular tightenable bracelet form that, when tightened, is operable to clamp the plurality of arc-shaped bracelet anodes to a fixed vertical position on the cylindrical subsection of the outer surface of the cellar-area well casing.

In such an exemplary embodiment, each respective arc-shaped bracelet anode of the plurality of arc-shaped bracelet anodes includes an arc-shaped anode frame to provide mechanical support to the respective arc-shaped bracelet anode, the arc-shaped anode frame having one or more brackets at each distal end to allow a mechanical connection to be made to one or more brackets of adjacent bracelet anodes in the substantially circular tightenable bracelet form, each of the one or more brackets having a fastener hole therein to receive a fastener.

In such an exemplary embodiment, each respective arc-shaped bracelet anode of the plurality of arc-shaped bracelet anodes further includes an arc-shaped anode core being integrally connected to the arc-shaped anode frame such that the arc-shaped anode frame is substantially embedded within the arc-shaped anode core, to allow a surface of the arc-shaped anode core to substantially circumferentially surround the cylindrical subsection of the outer surface of the cellar-area well casing to operably provide an ion pathway through the electrolytic composition between the surface of the arc-shaped anode core and the outer surface of the cellar-area well casing, the arc-shaped anode core defining an anode screw hole therein.

In such an exemplary embodiment, each respective arc-shaped bracelet anode of the plurality of arc-shaped bracelet anodes further includes a plurality of fasteners to mechanically connect each of the plurality of arc-shaped bracelet anodes to the one or more adjacent arc-shaped bracelet anodes in the substantially circular tightenable bracelet form, each of the plurality of fasteners adaptable to be positioned through the fastener hole in the bracket at each distal end of the arc-shaped anode frame of the respective arc-shaped bracelet anode and further through the fastener hole in the bracket at each distal end of the arc-shaped anode frame of the one or more adjacent arc-shaped bracelet anodes, thereby allowing the substantially circular tightenable bracelet form to be operably tightened by torque applied to the plurality of fasteners;

In such an exemplary embodiment, each respective arc-shaped bracelet anode of the plurality of arc-shaped bracelet anodes further includes one or more metallic shorting screws, each of the one or more metallic shorting screws to be positioned through the anode screw hole of a respective arc-shaped anode core for each of the plurality of arc-shaped bracelet anodes so that the respective metallic shorting screw is operable to contact the outer surface of the cellar-area well casing, each of the plurality of metallic shorting screws thereby operable to be in direct electrical contact with the respective arc-shaped anode core such that that each of the one or more metallic shorting screws is operable to complete an electrical connection between the respective arc-shaped anode core and the outer surface of the cellar-area well casing to provide an electron pathway between the respective arc-shaped anode core and the outer surface of the cellar-area well casing, the election pathway and the ion pathway completing an enhanced galvanic anode cathodic protection circuit.

Another exemplary embodiment of the present invention includes an enhanced cathodic protection system for a subterranean well casing having an upper vertical well casing section thereof in a cellar area and one or more lower well casing sections below the cellar area, the cellar area being bounded by a cellar ring, the vertical well casing section in the cellar area defining a cellar-area well casing.

In such an exemplary embodiment, the enhanced cathodic protection system includes an impressed current cathodic protection system comprising a subterranean anode bed surrounded by a ground electrolyte in communication with the one or more of the lower well casing sections, the subterranean anode bed adapted to provide a first ion pathway through the ground electrolyte to the one or more of the lower well casing sections, the subterranean anode bed further being electrically connected to the subterranean well casing through one or more cables and one or more cathodic protection rectifiers to provide a first electron pathway to the subterranean well casing, the impressed current cathodic protection system providing primary cathodic protection to the subterranean well casing.

In such an exemplary embodiment, the enhanced cathodic protection system further includes an enhanced galvanic anode cathodic protection system comprising one or more bracelet anodes being circumferentially mounted to the cellar-area well casing and being surrounded by a cellar electrolyte, the cellar electrolyte being bounded by the cellar ring and also surrounding an outer surface of the cellar-area well casing, the one or more bracelet anodes circumferentially surrounding the cellar-area well casing and providing a second ion pathway through the cellar electrolyte to the cellar-area well casing, the one or more bracelet anodes further being electrically connected to the cellar-area well casing through one or more shorting screws to provide a second electron pathway to the subterranean well casing, the enhanced galvanic anode cathodic protection system providing secondary cathodic protection to the subterranean well casing.

Yet another exemplary embodiment of the present invention includes a method for providing enhanced cathodic protection to a subterranean well casing having an upper vertical well casing section thereof in a cellar area and one or more lower well casing sections below the cellar area, the cellar area being bounded by a cellar ring, the vertical well casing section in the cellar area defining a cellar-area well casing.

In such an exemplary embodiment, the method includes the step of completing an impressed current cathodic protection circuit comprising a subterranean anode bed surrounded by a ground electrolyte in communication with the one or more of the lower well casing sections, the subterranean anode bed adapted to provide a first ion pathway through the ground electrolyte to the one or more of the lower well casing sections, the subterranean anode bed further being electrically connected to the subterranean well casing through one or more cables and one or more cathodic protection rectifiers to provide a first electron pathway to the subterranean well casing, the impressed current cathodic protection system providing primary cathodic protection to the subterranean well casing.

In such an exemplary embodiment, the method further includes the step of completing an enhanced galvanic anode cathodic protection circuit comprising one or more bracelet anodes being circumferentially mounted to the cellar-area well casing and being surrounded by a cellar electrolyte, the cellar electrolyte being bounded by the cellar ring and also surrounding an outer surface of the cellar-area well casing, the one or more bracelet anodes circumferentially surrounding the cellar-area well casing and providing a second ion pathway through the cellar electrolyte to the cellar-area well casing, the one or more bracelet anodes further being electrically connected to the cellar-area well casing through one or more shorting screws to provide a second electron pathway to the subterranean well casing, the enhanced galvanic anode cathodic protection system providing secondary cathodic protection to the subterranean well casing.

BRIEF DESCRIPTION OF THE DRAWINGS

So that the manner in which the features and benefits of the invention, as well as others which will become apparent, may be understood in more detail, a more particular description of the embodiments of the invention may be had by reference to the embodiments thereof which are illustrated in the appended drawings, which form a part of this specification. It is also to be noted, however, that the drawings illustrate only various embodiments of the invention and are therefore not to be considered limiting of the invention's scope as it may include other effective embodiments as well.

DETAILED DESCRIPTION

The present invention relates to cathodic protection for one or more well casing sections enclosed by the cellar area of an oil or water well. As can be shown with reference to FIG. 1, the cellar area 100 is bounded by a cellar ring 101 installed in the earth, partially or completely below the earth surface 107, near the well head 102. The cellar ring 101, is generally installed prior to drilling operations to secure the hole while drilling, and is usually left remaining during production operations. The cellar ring 101 can have a shape that is substantially cylindrical, for example, as can be shown with reference to the cutaway-view drawing in FIG. 1 and the elevation-view drawing in FIG. 3*b*. In other embodiments, as will be apparent to those having skill in the art, cellar ring 101 can be any closed or substantially closed shape. The cellar ring 101, as will be understood by those having skill in the art, can be composed of a cellar material that includes metallic matter, non-metallic matter (i.e., concrete), or both metallic matter and non-metallic matter.

Figure 1:
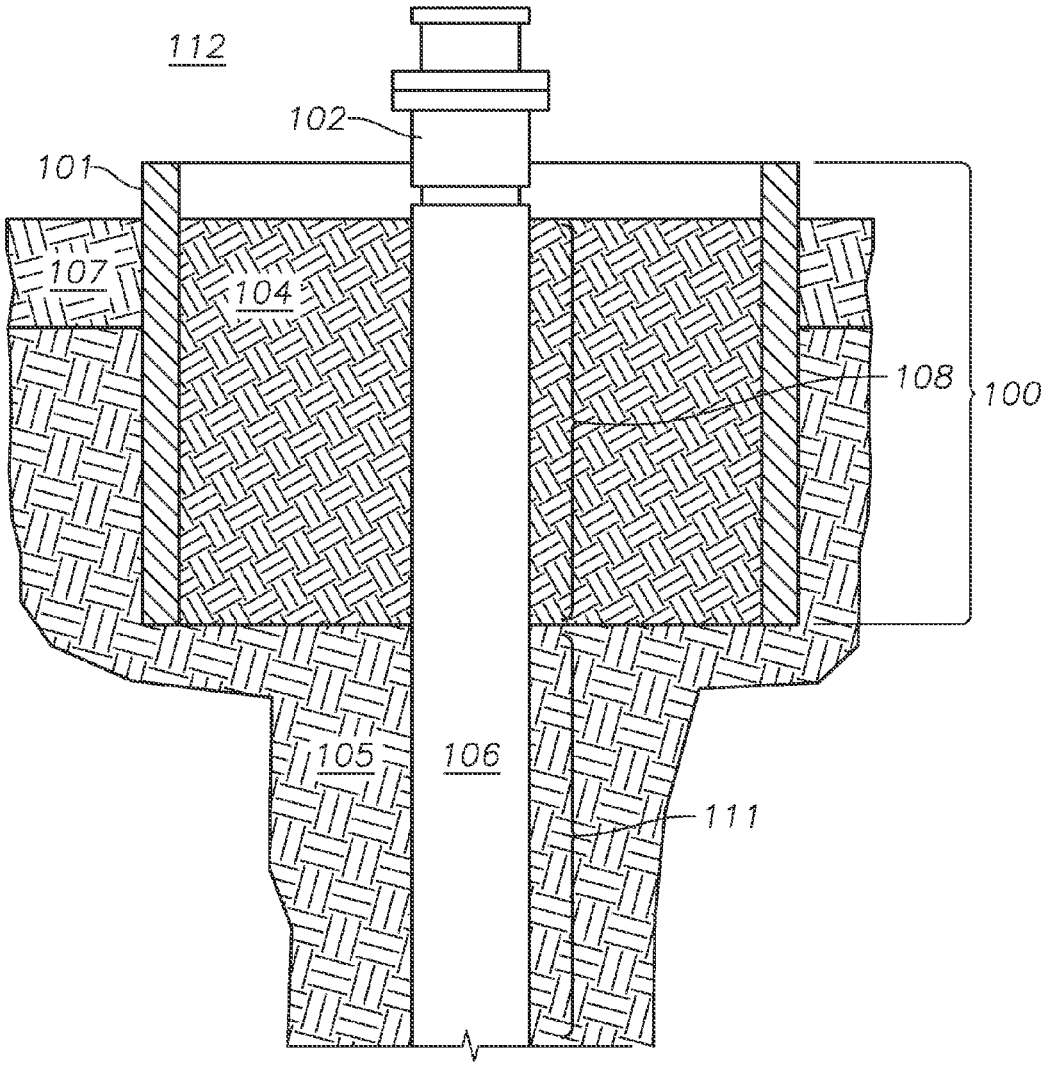
FIG. 1 is a schematic elevation cross-section of a subterranean well casing and a cellar area of a well.
Figure 3A:
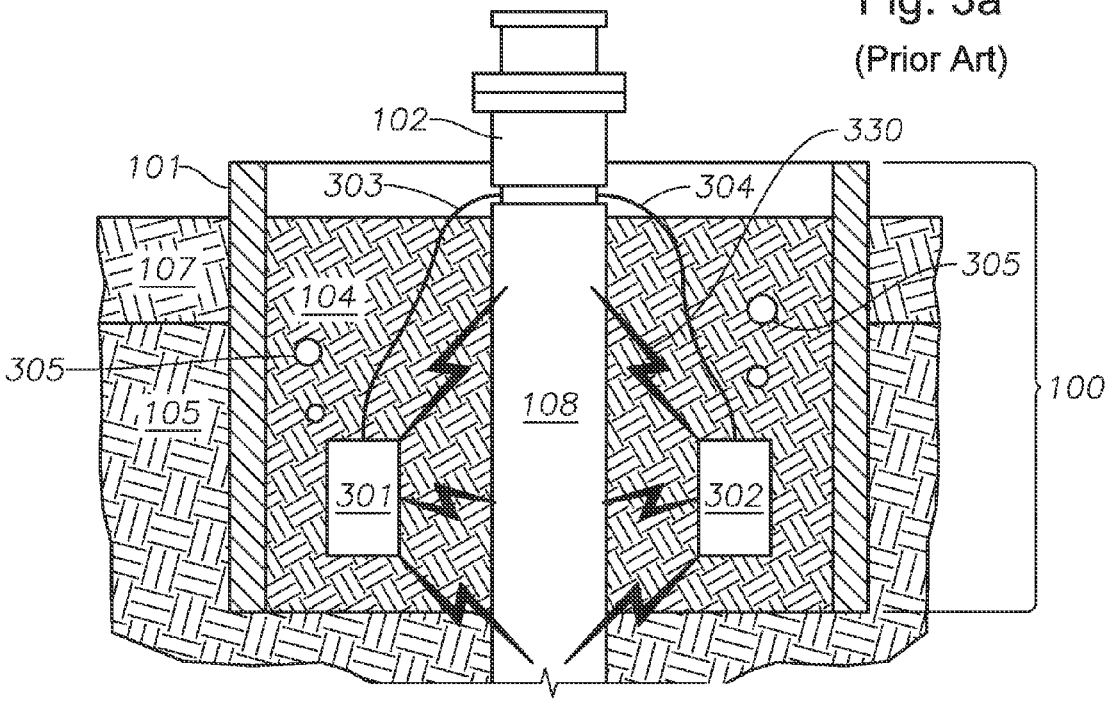
Fig. 3a (Prior Art)
FIG. 3*a* is a schematic elevation cross-section of a subterranean well casing, a cellar area of a well, and a known galvanic anode cathodic protection system to protect a section of the well casing inside the cellar area of the well.
Figure 3B:
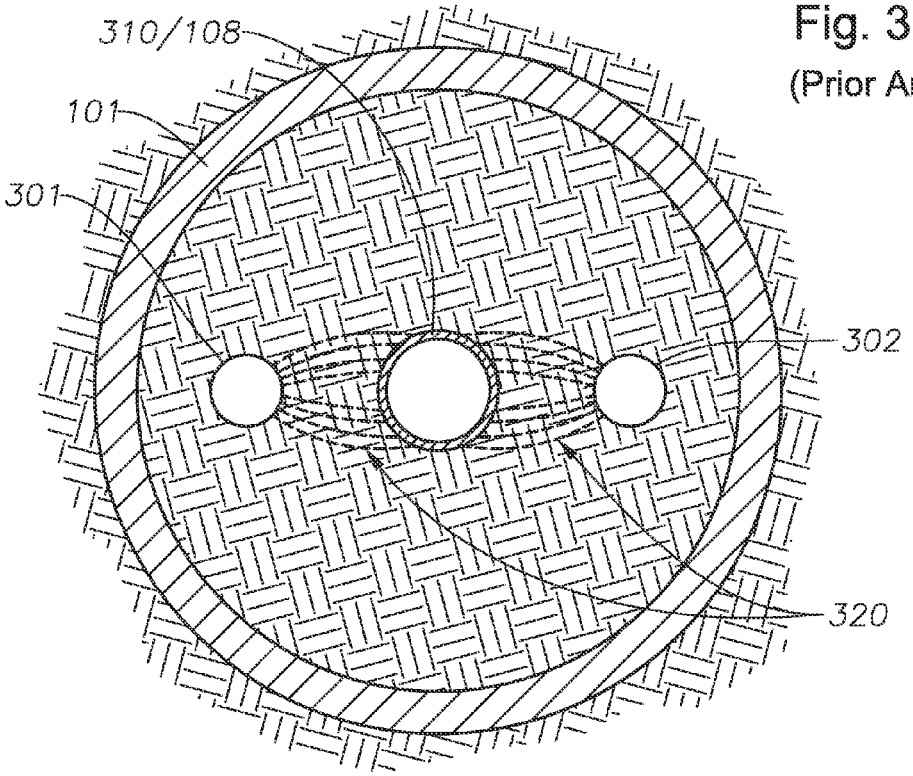
Fig. 3b (Prior Art)
FIG. 3*b* is a schematic plan cross-section of a subterranean well casing, a cellar area of a well, and a known galvanic anode cathodic protection system to protect a section of the well casing inside the cellar area of the well.

As can further be shown with reference to FIG. 1 and FIG. 3*b*, the cellar ring 101 surrounds one or more sections of a well casing 106 on all sides, and such section or sections are referred to herein as the enclosed section 108 of the well casing 106 or, simply, the cellar-area well casing 108. Between the cellar ring 101 and the enclosed section 108 of the well casing 106 there is a substantial space, which can be filled or occupied in whole or in part by backfill 104. Backfill 104 can include, for example, earth media including moist soil as well as any foreign particles such as oil, concrete, drilling mud, and like byproducts of the drilling operations or production operations that, from time to time, tend to accumulate therein (i.e., non-homogenous backfill).

Below the cellar area 100 and supporting the backfill 104 is the earth subsurface 105, which includes earth media such as mud, rock, sand, reservoirs, and like subterranean earth media or structures. The cellar ring 101 extends through the earth surface 107 so that the cellar-area well casing 108 is substantially surrounded by backfill 104, atmosphere 112, or by backfill 104 and atmosphere 112. As can be shown with reference to FIG. 1, portions of the well casing, including the well head 102 can be positioned above the cellar area. In certain embodiments, however, the well head 102 can be positioned within the cellar area and would be included in the definition of the enclosed section 108 or the cellar-area well casing 108.

Figure 2:
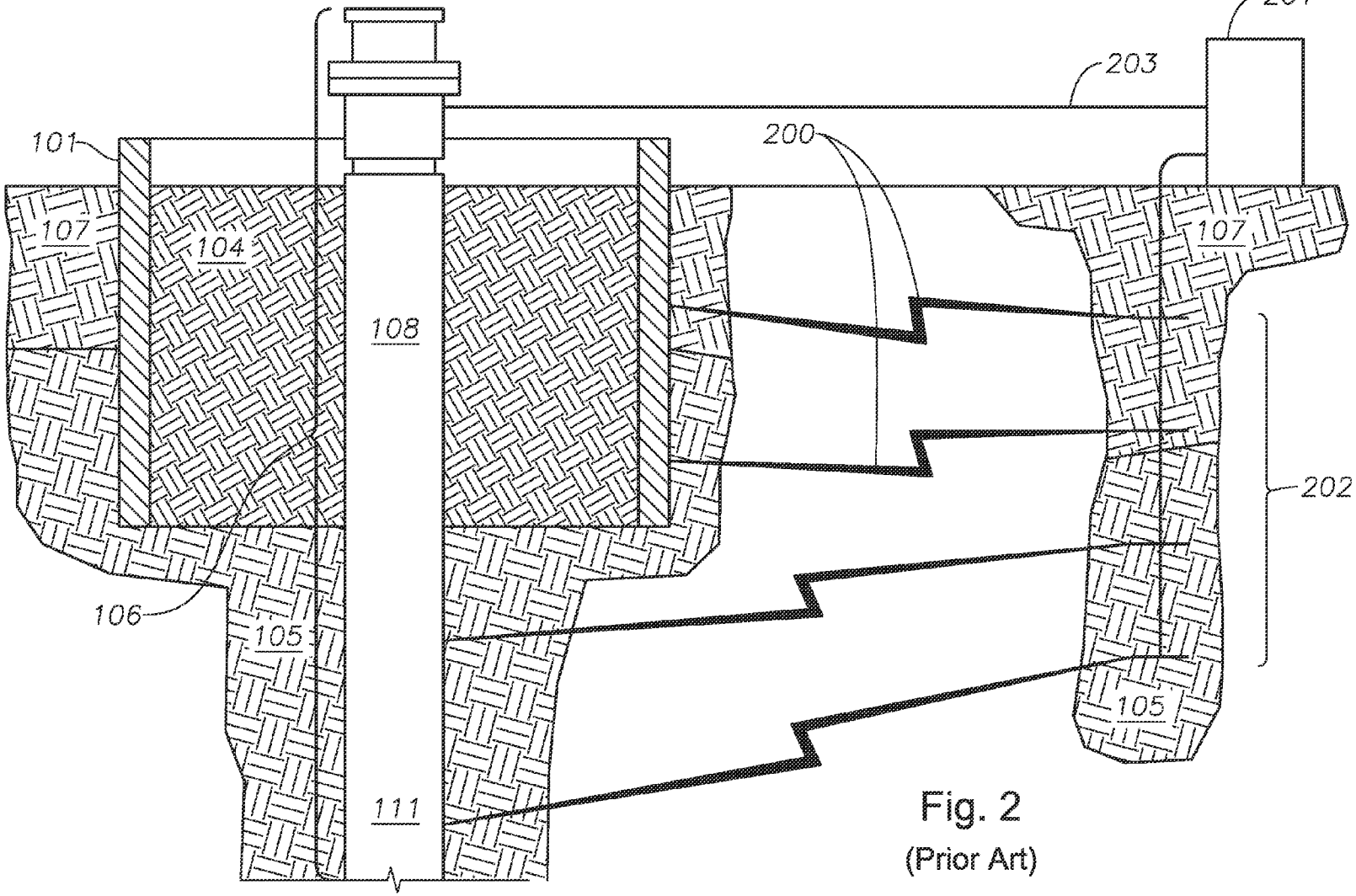
Fig. 2 (Prior Art)
FIG. 2 is a schematic elevation cross-section of a subterranean well casing and a cellar area of a well, and a known impressed current cathodic protection system to protect a the well casing outside the cellar area of the well.

A conventional ICCP system used to protect the well casing can be shown with reference to FIG. 2. In such an ICCP system, anodes in a deep anode bed 202 are driven by an A/C rectifier 201. One or more ion pathways 200 between the deep anode bed 202 and the well casing 106 is disadvantageously shielded, in whole or in part, from the enclosed section 108 of the well casing 106 by the cellar ring 101 as well as by the backfill 104. The distance between the deep anode bed 202 and the surface of the well casing 106 will differ depending on the rectifier rating and whether the well casing 106 is externally coated; but as will be appreciated by those having skill in the art, the distance in certain applications can be approximately 150 meters. Backfill 104 in the cellar 100 can further shield the ion pathway 200 from the enclosed section 108 of the well casing 106, for example, due to pollutants in the backfill 104. The cellar ring 101 and the backfill 104, accordingly, disadvantageously shield the ion pathways through an electrolyte in the earth media 105 from the enclosed section 108 of the well casing 106, thus preventing effective protection of the entire well casing 106, including any associated flow lines or other metallic components of the well, such as the well head 202.

A conventional GACP system used to protect the enclosed section 108 of the well casing 106 in the cellar area 100 can be shown with reference to FIGS. 3*a* and 3*b*. In such a GACP system, localized protection of the enclosed section 108 of the well casing 106 was provided by pre-packaged magnesium anodes 301 and 302 placed into the backfill 104 within the cellar 100, being positioned in or otherwise supported by the backfill 104. As the backfill 104 tends to become polluted over time throughout the drilling and production operations for example, with drilling mud, oil, cement, drilling debris, formation water, and other pollutants the electrical resistance of the GACP system disadvantageously increases due to the resulting non-homogeneity of the electrolyte 104 in the ion pathways between the pre-packaged magnesium anodes 301 and 302 and the enclosed section 108 of the well casing 106. Accordingly, the backfill 104 must periodically be replaced in order to remove the pollutants, such as pollutants 305, and thereby ensure a threshold level of homogeneity in, and maintain the conductivity of the backfill 104. The GACP system including the pre-packaged magnesium anodes 301 and 302 further requires cables 303 and 304, providing an electrical connection between the anodes 301 and 302, respectively, and the enclosed section 108 of the well casing 106, in order to complete the electrochemical cell and thereby provide cathodic protection to the cellar-area well casing 108.

Figure 4A:
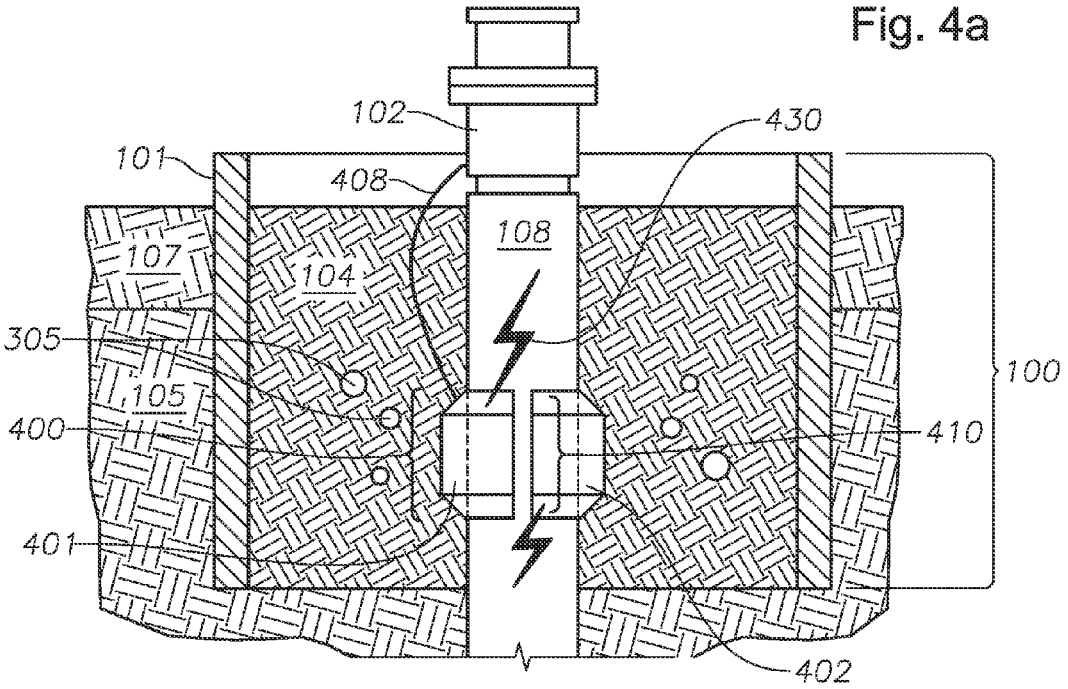
FIG. 4*a* is a schematic elevation cross-section of a subterranean well casing, a cellar area of a well, and an enhanced galvanic anode cathodic protection system, according to an embodiment of the present invention, to protect a section of the well casing inside the cellar area of the well.
Figure 4B:
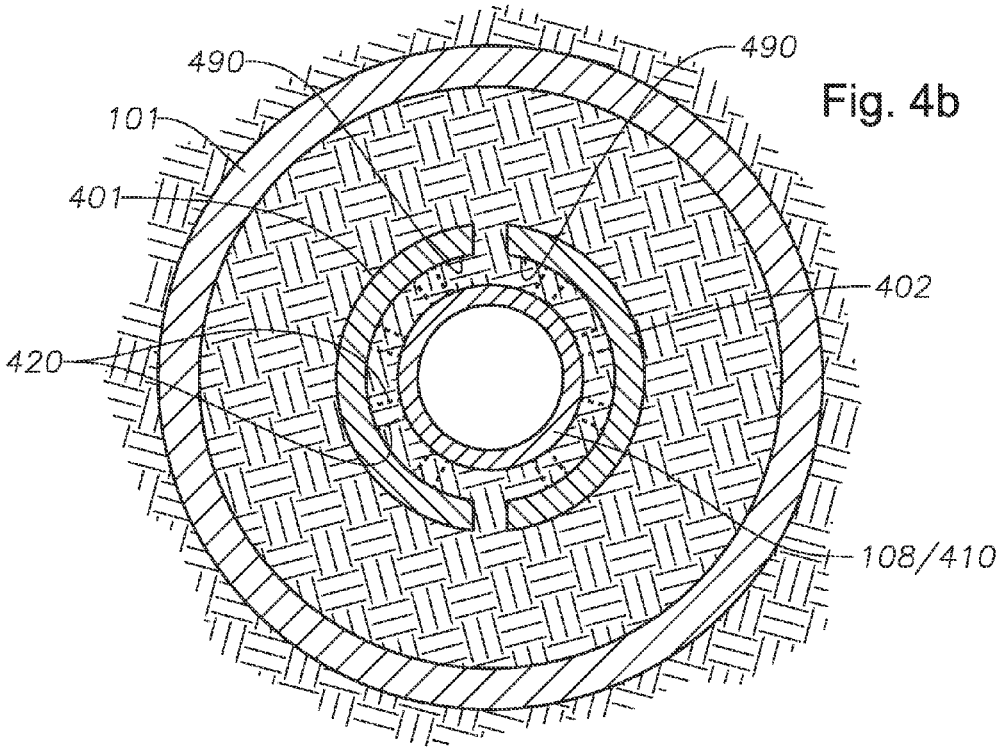
FIG. 4*b* is a schematic plan cross-section of the subterranean well casing, the cellar area of a well, and the enhanced galvanic anode cathodic protection system of the embodiment of FIG. 4*a*.
Figure 4C:
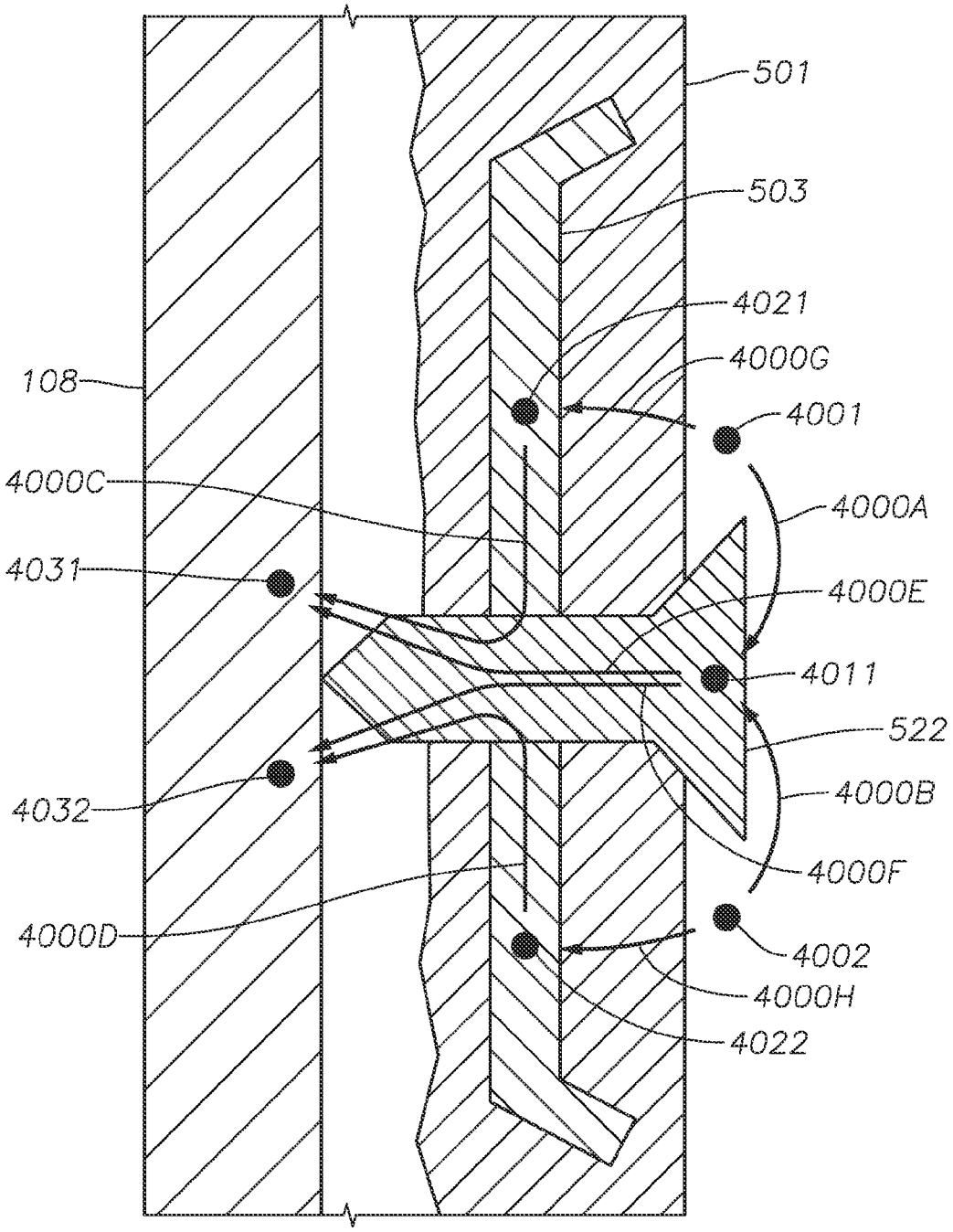
FIG. 4*c* is a schematic elevation cross-section of the subterranean well casing and the enhanced galvanic anode cathodic protection system of the embodiment of FIG. 4*a*, showing an enlarged view of an installed shorting screw.
Figure 5A:
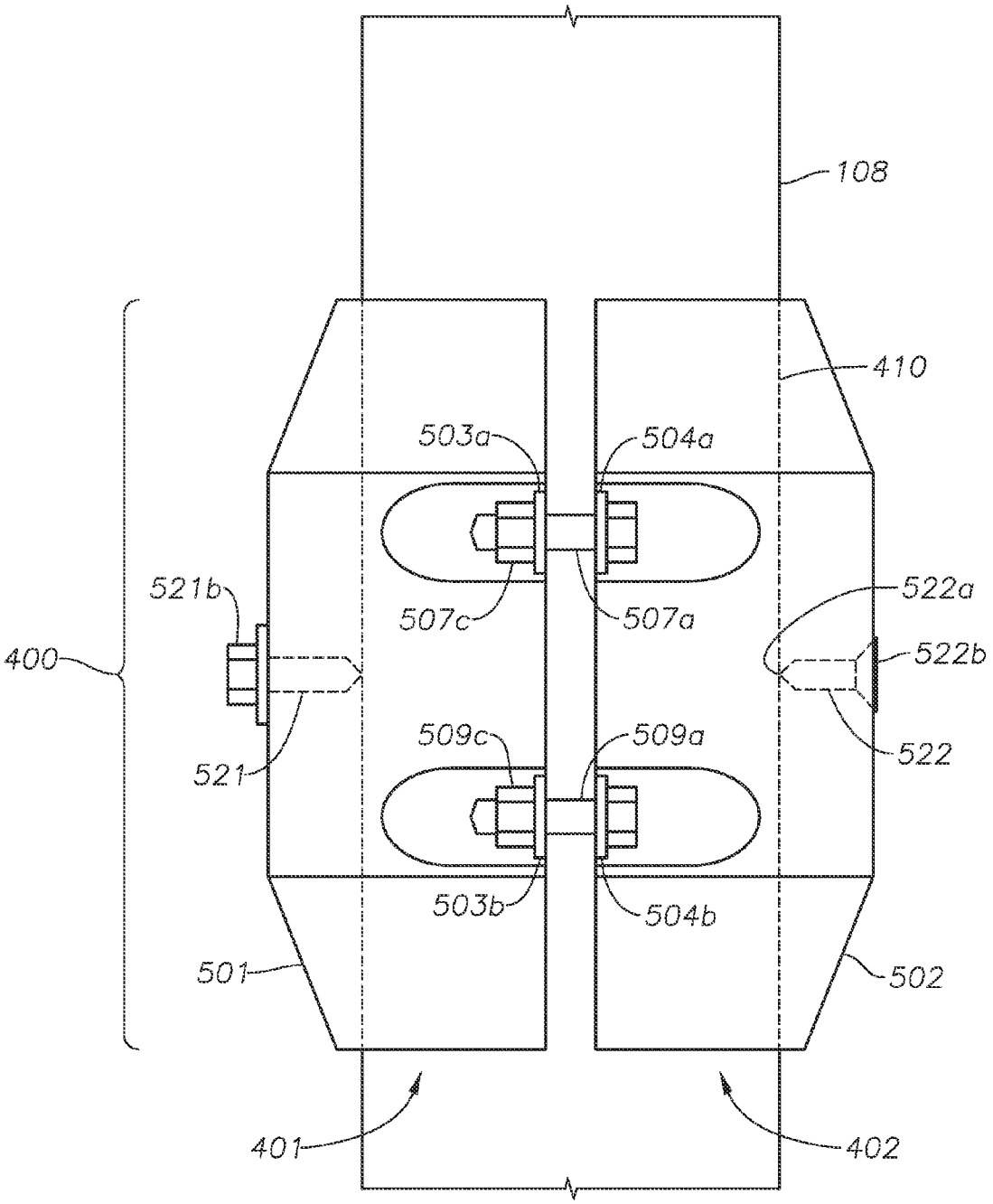
FIG. 5*a* is an elevation view drawing (and transparency) of an enhanced galvanic anode cathodic protection system, according to an embodiment of the present invention, to protect a section of the well casing inside the cellar area of the well.
Figure 5B:
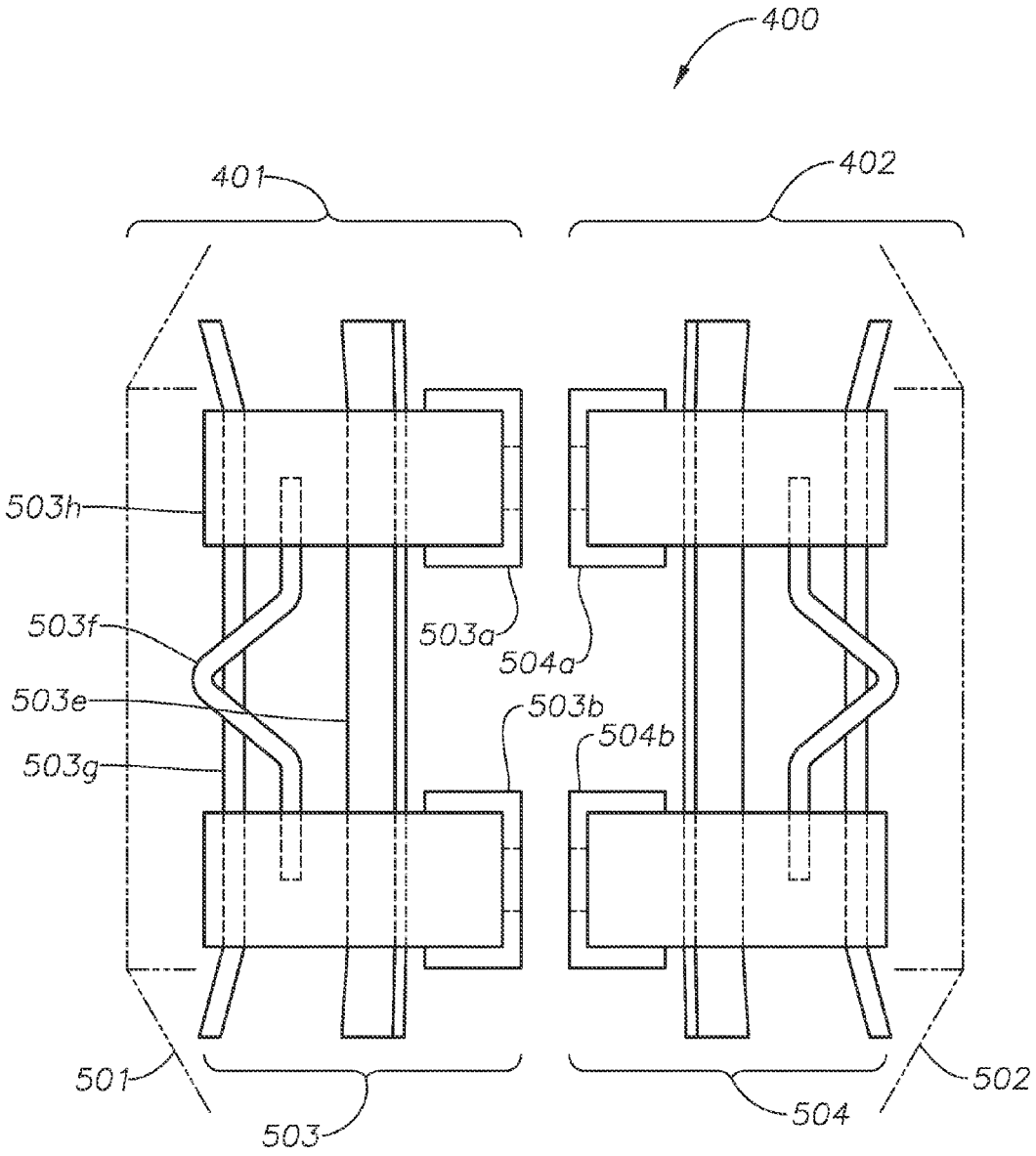
FIG. 5*b* is an elevation view cross-section (and transparency) of the enhanced galvanic anode cathodic protection system of FIG. 5*a*, showing the anode frame.
Figure 5C:
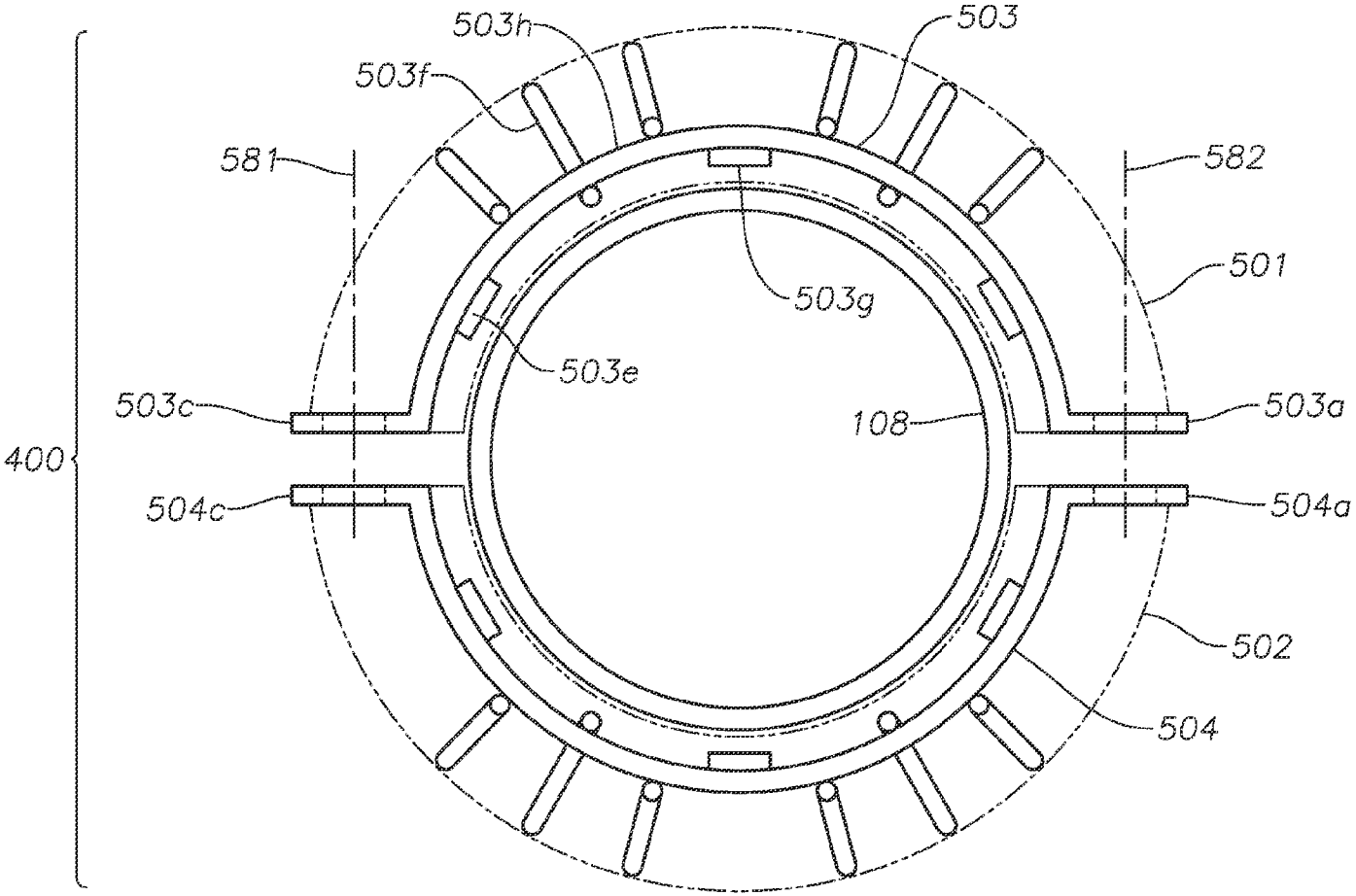
FIG. 5*c* is a plan view drawing (and transparency) of the enhanced galvanic anode cathodic protection system of FIG. 5*a*, showing the anode frame
Figure 5E:
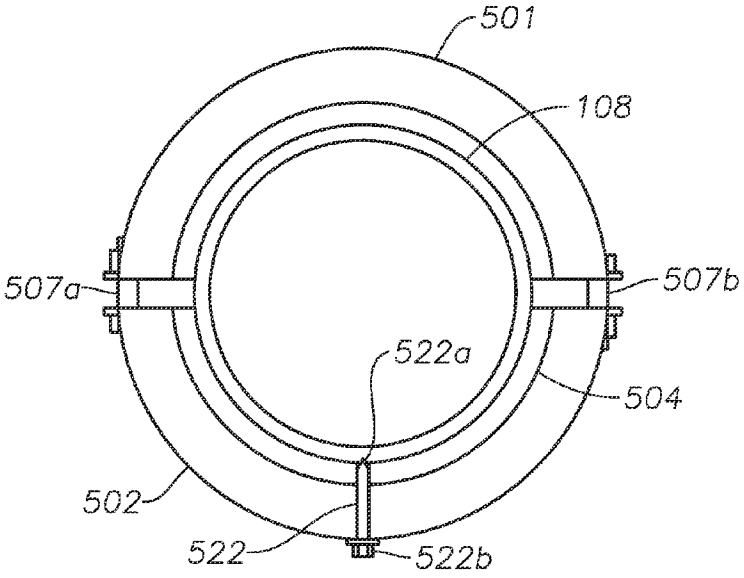
FIG. 5*e* is a plan view cross-section of the enhanced galvanic anode cathodic protection system of FIG. 5*a*, showing the anode installed on a section of casing.

Exemplary embodiments of the present invention providing enhanced galvanic anode cathodic protection to the cellar-area well casing 108 can be shown with reference to FIGS. 4*a-c* and FIGS. 5*a-c*. The exemplary embodiments as illustrated in these drawings and as described herein include an enhanced bracelet anode assembly having two substantially arc-shaped, or more particularly, semicircular or substantially semicircular, anodes circumferentially mounted to the cellar-area well casing 108. For example, arc-shaped bracelet anodes 401 and 402, having a substantially semicircular shape, as shown in FIG. 4*a* and FIG. 4*b*, being positioned horizontally opposed and mechanically connected to surround a vertical well casing section, operably form a substantially circular anode assembly 400 having a substantially cylindrical inner anode surface positioned radially adjacent to the outer surface of the cellar-area well casing 108. Those having skill in the art will appreciate that substantially semicircular anodes may have an arc length slightly less than $\pi r$, which, in FIG. 5*c* is shown as being approximately 14/15 of $\pi r$ (r being the radius of the arc-shaped anode). In this disclosure, the terms "semicircular" and "substantially semicircular" have been used interchangeably in light of the foregoing.

Those having skill in the art will appreciate, however, that the invention is not limited to embodiments having only two substantially semicircular anodes being positioned horizontally opposed. Certain embodiments, for example, may have three or more arc-shaped anodes that can be positioned horizontally along the circumference of the well cellar-area well casing 108 and mechanically connected to surround a well casing and form a substantially circular anode assembly. Those having skill in the art will understand that the degree to which the anodes are required to be arc-shaped, in different embodiments of the present invention, will depend on the number of anodes used, the spacing between the anodes, and the circumference of the cellar-area well casing 108. Accordingly, certain embodiments of the present invention having many anodes, e.g., more than six anodes, can incorporate anodes that are flat or substantially flat. Furthermore, those having skill in the art will appreciate that the invention is not limited to embodiments in which the two or more arc-shaped anodes are equal in size or equal in arc length. The substantially circular anode assembly 400, as, perhaps, can best be shown with reference to FIG. 4*b*, need not surround the cellar-area well casing 108 in all 360 degrees of the circumference of the well casing 108—gaps between the bracelet anodes 401, 402 are permitted, as will be understood by those having skill in the art (in FIG. 5*c*, gaps are shown as being approximately 1/15 of πr).

In other embodiments, however, the substantially circular anode assembly can include two arc-shaped anodes having a much shorter arc length, for example, approximately one-quarter of the outer diameter of the cellar-area well casing, and the arc-shaped anodes can flank the cellar-area well casing 108 like parentheses, leaving more substantial gaps along the circumference of the outer surface of the cellar-area well casing.

As can be shown with reference to FIG. 4*a*, two anodes, for example semicircular bracelet anodes 401 and 402, can be mounted circumferentially around the cellar-area well casing 108. In certain embodiments, the cellar-area well casing 108 can be a bare casing having an exposed metal surface. In other embodiments, the cellar-area, well casing 108 can be a coated casing, for example, having a fusion-bonded epoxy ("FBE") coating on the outer surface of the cellar-area well casing 108. Those having skill in the art will appreciate other types of coating that can also be used. Also, in certain embodiments, the well casing 106 can be coated below the cellar-area well casing 108, for example, all the way down through the earth media 105 to the deepest corrosive zone. In other embodiments, the well casing 106 can be coated below the cellar-area well casing 108 but only at the upper casings (e.g., the upper 4,000 feet of well casing below the cellar-area well casing 108) so that the cathodic protection current provided by the ICCP system will be forced to cover deeper zones down the well casing 106.

Returning to FIG. 4*a* and FIG. 4*b*, mounting the bracelet anodes 401 and 402 circumferentially around the cellar-area well casing 108 to form a substantially circular anode assembly 400 minimizes the mean distance between the outer surfaces of the anodes and all points on the outer surface of the cathode (i.e., the outer surface of the cellar-area well casing 108) as compared to the use of pre-packaged anodes illustrated in FIGS. 3*a* and 3*b*. As can be shown with reference to FIG. 4*b*, circumferentially mounting the bracelet anodes 401 and 402 to substantially surround the cellar-area well casing 108, minimizes the mean horizontal length of the ion pathways 420 between the anode material and the cathode material (the well casing 108) while also minimizing the variance of the horizontal length of the ion pathways 420 between the surface of the anode material and the surface of the cathode material (the well casing 108), as can be shown by comparing such to the horizontal length of the ion pathways 320 between the prepackaged anodes 301, 302 and the well casing 108 with reference to FIG. 3*a*.

Minimizing the horizontal length of the ion pathway can be shown in the cutaway plane with reference to the ion pathway 330 in FIG. 3*a* and the enhanced ion pathway 430 in FIG. 4*a*. As will be appreciated by those having skill in the art, the ion pathway will be shortest for the cylindrical subsection surface 410 of the well casing that is surrounded by the anodes (i.e., the portion of the well-casing immediately adjacent to the bracelet anodes 401 and 402). Nevertheless, the mean length of the ion pathway between the bracelet anodes 401 and 402 and all portions of the cellar-area well casing that are not immediately adjacent to the bracelet anodes 401 and 402 are also minimized over that provided through the known use of pre-packaged anodes illustrated in FIGS. 3*a* and 3*b*.

Accordingly, the substantially circular anode assembly can advantageously reduce the horizontal length of the ion path way with respect to all points along the outer circumference of the well casing, which beneficially reduces the resistance through the backfill 104 to points along the outer circumference of the well casing thereby enhancing cathodic protection thereto. By reducing the length of the ion pathway, e.g., ion pathways 420, through the backfill 104 between the anode and cathode, the absolute quantity of pollutants in the ion pathway, for any given density of pollutants or degree of non-homogeneity, can be reduced. Further, by reducing the length of the ion pathway, e.g., ion pathways 420, through the backfill 104 between the anode and cathode, any given quantity of pollutants in the ion pathway has less effect on the resistivity of the backfill 104 through the ion pathway. Accordingly, the effectiveness of the enhanced cathodic protection system is increased, thereby increasing the degree of cathodic protection provided to the cellar-area well casing 108 and better protecting the cellar-area well casing 108 from corrosion.

Advantageously, the bracelet anodes 401 and 402 can be positioned so as to circumferentially surround the subsection of the cellar-area well casing that is most susceptible to corrosion, thereby most substantially minimizing the ion pathway length between the bracelet anodes 401 and 402 and the subsection of the cellar-area of the well most susceptible to corrosion. Accordingly, cathodic protection can be beneficially enhanced especially for a specific cylindrical subsection 410 as well as for the overall surface of the cellar-area well casing 108.

As can be further shown with reference to FIG. 4*b*, one or more bracelet anodes 401 and 402 can have an arc shape that substantially matches the cylindrical shape of the outer surface of the cellar-area well casing 108. In embodiments of the present invention having only two anodes, for example, such as bracelet anodes 401 and 402, the anodes can have a substantially semi-circular shape that, when positioned horizontally opposed to surround the cellar-area well casing 108, form a substantially circular anode assembly having an inner anode surface 490, comprising the arc-shaped inner surface of the anodes, which surrounds the outer surface 410 of the cellar-area well casing 108. The anodes can be constructed so that the arc-shaped inner surface of the anodes, such as bracelet anodes 401 and 402, has a radius that substantially matches that of the outer surface of the cellar-area well casing 108. In certain embodiments, for example, the anodes can be constructed to substantially match any standard outer radius for well casings, such as 21 inches, 18 inches, 16 inches, or 15 inches (i.e., for standard pipe outer-diameters of 42 inches, 36 inches, 32 inches, or 30 inches, respectively).

According to embodiments of the invention, anodes used in the anode assembly 400 are preferably composed of magnesium or zinc. Although aluminum anodes are available—such as those used in applications for protecting sub-marine pipelines—aluminum anodes perform unfavorably in soil applications having low chlorides. Once exposed to oxygen in the atmosphere, aluminum anodes develop a hard, permanent, and intact surface oxide film (aluminum oxide). Where the application involves water rich in chlorides, the aluminum oxide will be removed in a chemical reaction with the chlorides. For soil applications, magnesium anodes can be either standard or high-potential magnesium, and zinc anodes can be of any type intended for soil applications.

In further detail, as can be shown with reference to FIG. 5*a* and FIG. 5*b*, any anode of the foregoing embodiments can be a bracelet anode, such as bracelet anode 401, which includes an anode core 501 and an anode frame 503. The anode frame 503 can be considered the "skeleton" of the bracelet anode 401 and, as such, the anode frame 503 is provided for structural support of the bracelet anode 401 as well as for a rigid and durable anchor point to connect the bracelet anode 401 to another bracelet anode, such as bracelet anode 402.

The structure of an exemplary bracelet anode 401 according to one embodiment can be shown with reference to FIG. 5*b* and FIG. 5*c*. The anode core 501 is the actual anode metal, such as zinc or magnesium. The anode frame 503 can be composed of any structurally sufficient metal, such as carbon steel. The anode frame 503 can consist of several interconnected components just as a skeleton would consist of several bones. The anode frame 503 illustrated in FIG. 5*b* and FIG. 5*c*, for example, includes several bands, rods, plates, and brackets. For example, band 503*h*, rod 503*f* and plates 503*g* and 503*e*, and brackets 503*a* and 503*c* can be interconnected as shown in FIG. 5*b* and FIG. 5*c* according to various techniques known to those having skill in the art, for example, using TIG welds.

Band 503*h*, rod 503*f* and plates 503*g* and 503*e*, and brackets 503*a* and 503*c* can further provide a surface for the anode core 501 to mechanically connect. In the embodiment illustrated in FIGS. 5*b* and 5*c*, the anode core 501 is mechanically and electrically connected to the anode frame 503 through a bond or a friction grip facilitated by solidification of the anode core 501 to surround the anode frame 503. The anode core 501 can be poured or laid as molten metal into a mold containing the anode frame 503 such that the molten anode core 501 substantially surrounds the anode frame 503 on all sides and the anode frame 503 thereby becomes substantially embedded in the anode core 501 so that the anode frame 503 and the anode core 501 are integrally connected. The brackets, such as the four brackets 503*a-d* of the anode frame 503, however remain exposed to facilitate electrical connections between one or more anode frames 503. The friction grip can be strengthened, for example, by media-blasting the anode frame before the molten anode core 501 is poured into the mold. A coating on the anode frame 503 would be undesirable to the extent such coating would not withstand the melting point of the anode core or to the extent that the friction grip with the anode core 501 could be compromised by the coating.

The construction of the bracelet anode assembly 400 can be shown with reference to FIG. 5*a*, FIG. 5*b*, and FIG. 5*c*. In FIG. 5*a*, bracelet anode 401 is connected to the other bracelet anode 402 using a connector. One example of a connector can be fasteners 507*a* and 509*a* (fasteners 507*b* and 509*b* on the opposite side not shown) to mechanically connect the respective brackets 503*a-b* of anode frame 503 (brackets 503*c* and 503*d* on the opposite side not shown) to the brackets 504*a-b* of anode frame 504 (brackets 504*c* and 504*d* on the opposite side not shown). Fasteners can include, for example, both a bolt (as shown in the drawings) as well as nuts, such as nuts 507*c* and 509*c*. As is described further herein, the mechanical connection provided by fasteners 507*a-b* and 509*a-b* and the torque applied thereto provides the compressive clamping force by the bracelet anode assembly 400 upon the circumference of the cylindrical subsection 410 of the outer surface of the cellar-area well casing 108. Alternatively, connectors such as latches or hinges can be used to latch bracelet anode 401 to bracelet anode 402. For example, a hinge can be used to secure one end of bracelet anode 401 to an end of bracelet anode 402. A draw latch or tension latch can be used to one end of bracelet anode 401 toward the other end of bracelet anode 402 and secure the ends together. Similarly, fasteners can be used on one end of bracelet anodes 401, 402 while a hinge or tension latch is used on the other end. As one of skill in the art will appreciate, any variety of latching mechanisms can be used to secure the respective ends of bracelet anode 401 and anode 402, provided that the latching mechanisms impart sufficient clamping force to hold the bracelet anodes 401 and 402 on casing 108. Brackets 503*a-d* can be configured so that any of the various types of connectors can be attached to the brackets 503*a-d*.

In even further detail, an elevation view illustrating the substantially circular shape of the anode assembly 400, can be shown with reference to FIG. 5*c*. When fasteners 507*a-b* (FIG. 5*a*) and 509*a-b* (FIG. 5*a*) are tightened along axes 581 and 582 and secured to both anode frames 503 and 504 at brackets 503*a*, 503*c* and brackets 504*a*, 504*c*, the force applied to the anode frames 503 and 504, operably clamps the bracelet anode assembly 400, having a substantially circular tightenable bracelet form, circumferentially along the outer surface of the cellar-area well casing 108. As can be shown with respect to FIG. 5*a*, such clamping of the bracelet anode assembly 400 operably mounts the bracelet anode assembly 400 at a fixed vertical position (at the cylindrical subsection 410) along the outer surface of the cellar-area well casing 108.

The actual torque on fasteners 507*a-b* and 509*a-b* will be a function of the well casing outer diameter, which also determines the diameter of the bracelet anode. In general, adequate torque requirements for a ¾ inch bolt having 10 threads per inch will be in the following range: plain steel 350-425 ft-lbs, galvanized steel 438-531 ft-lbs, and waxed steel 175-213 ft-lbs. The clamping force on the well casing will also be a function of the anode weight. For an exemplary anode weight for a bracelet anode assembly of 110 kg net, the shear force will be 110 kg for all four fasteners which will be 27 kg of weight per fastener. In an exemplary embodiment as can be shown with reference to FIG. 5*f*, fasteners 507*a-d* and 509*a-d* can be routed though screw holes 511*a-d* and 512*a-d*, which are positioned in the brackets 503*a-b* and brackets 504*a-b* along axes 581 and 582 as can be shown in the elevation plane with reference to FIG. 5*c*). Brackets 503*a-d* and 504*a-d*, as can, perhaps, best be shown in FIG. 5*c* with respect to brackets 503*a* and 503*c* in FIG. 5*c*, are positioned at distal ends of the respective anode frames. Where the anode frame 503 is substantially semicircular, as can be shown in FIG. 5*c*, the bracket 503*a* can project from the substantially semicircular portion of the anode frame 503 at a substantially normal angle, such that the two opposing brackets of horizontally opposed anode frames, such as brackets 503*c* and 504*c* are positioned substantially parallel to each other. The degree to which the angle will deviate from being a perfectly normal angle, as will be appreciated by those having skill in the art, is equivalent to the degree to which the anode frames deviate from being a complete semicircle. The screw holes can be unthreaded, as is illustrated in FIG. 5*f* with respect to screw holes 511*a-d* and 512*a-d*. In such an embodiment, nuts 507*c-d* and 509*c-d* can be used. Alternatively, screw holes in the brackets of the anode frame opposing that connected to the bolt head, such as brackets 503*a* and 503*b*, can be threaded, and in such an embodiment, nuts 507*c-d* and 509*c-d* would not be used. Embodiments using nuts 507*c-d* and 509*c-d* advantageously allow anode frames 503 and 504 to be constructed substantially identically, thereby enhancing manufacturing, distributing, and operating efficiencies.

Figure 5D:
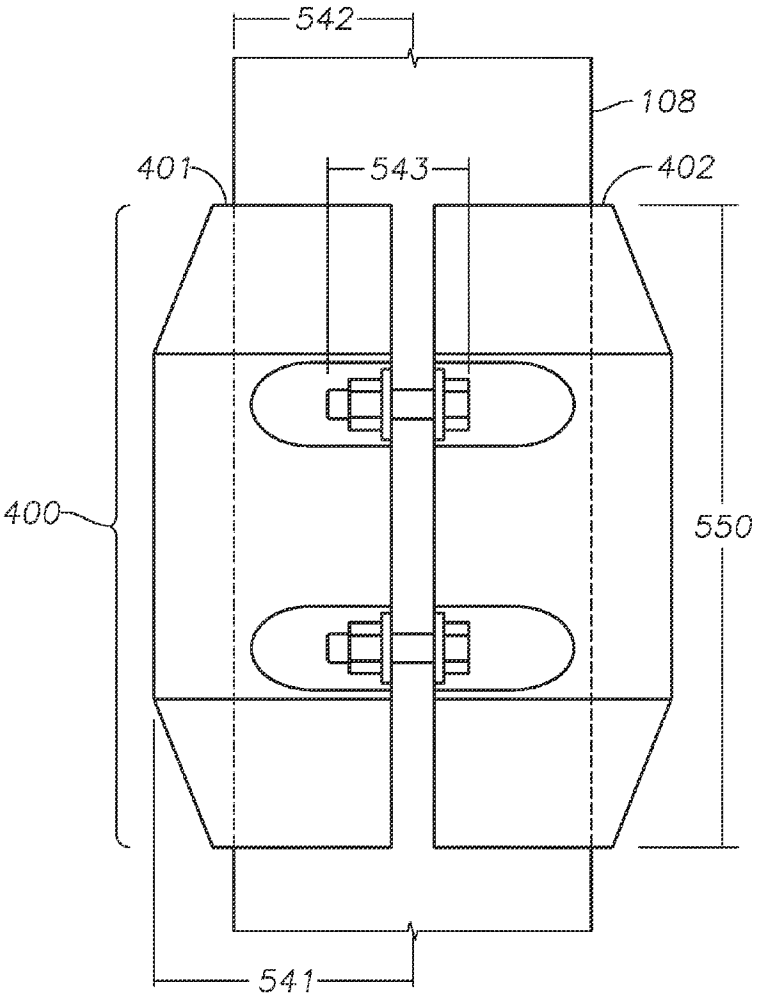
FIG. 5*d* is a elevation view drawing (and transparency) of the enhanced galvanic anode cathodic protection system of FIG. 5*a*, illustrating exemplary dimensions of various components of the system.
Figure 5F:
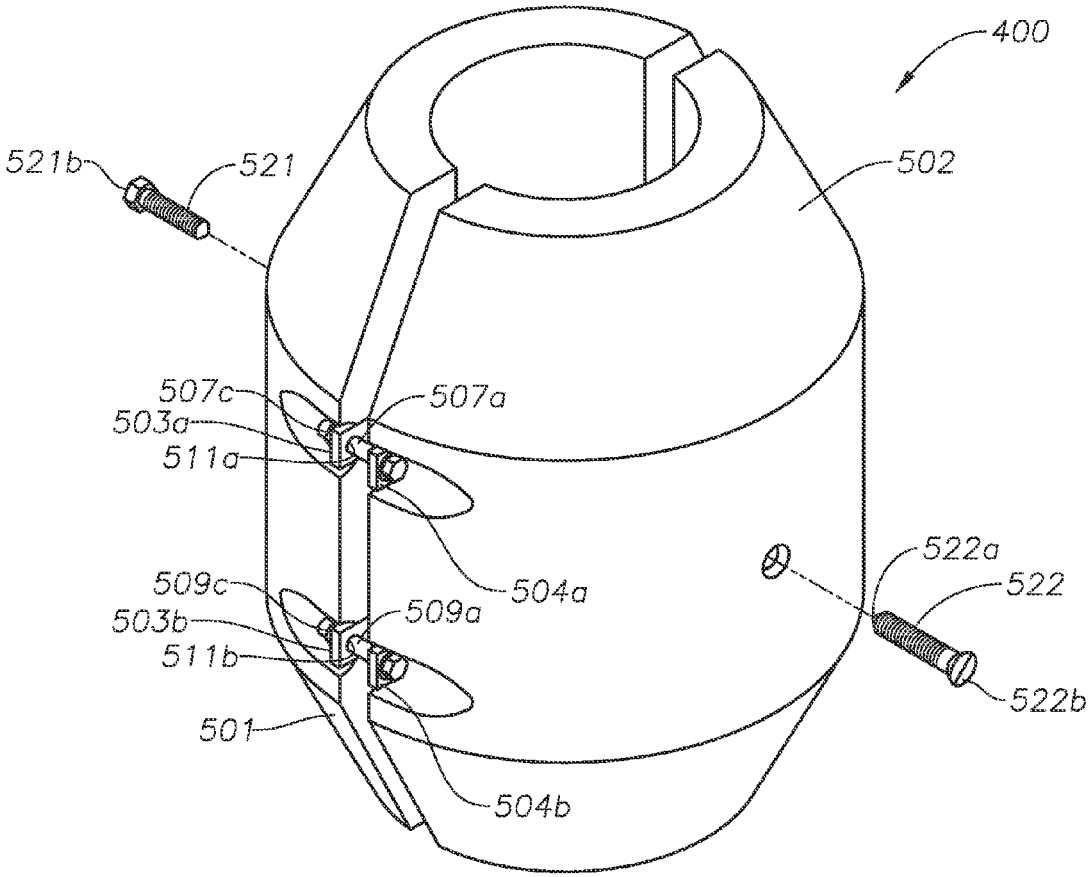
FIG. 5*f* is an isometric view drawing of the enhanced galvanic anode cathodic protection system of FIG. 5*a*.

In an exemplary embodiment as can be shown with reference to FIG. 5*d*, the bracelet anodes assembly 400 (and, correspondingly, each of the bracelet anodes 401 and 402) can have a vertical height dimension 550 in a range of 12-20 inches, an outer radius dimension 541 in a range of 1-2 inches greater than the outer radius 542 of the cellar-area well casing 108 (which can be, for example, 21 inches), and a net weight dimension in a range of 60-70 kg for a well casing 108 having a 42-inch outer diameter (or for a well casing having a 30-inch outer diameter, a net weight dimension in a range of 40-50 kg). The nominal weight for the bracelet anode assembly 400 can be in a range of 150-170 kg for a well casing 108 having a 42-inch outer diameter (or for a well casing having a 30-inch outer diameter, a nominal weight dimension of 110-130 kg). Furthermore, any of fasteners 507*a-b* or 509*a-b*, which provide compressive force to the bracelet anode assembly 400 so as to stabilize the vertical position thereof on the well casing 108, can be a 0.75-inch diameter bolt having a length dimension 443 of approximately 15 cm. Those having skill in the art will appreciate that the approximate dimensions describe herein describe only one embodiment having two bracelet anodes, and can be varied according to, for example, different sizes of well casing or according to, for example, different numbers of bracelet anodes used.

Embodiments of the invention provide a bracelet anode assembly for a cathodic protection system (a GACP system) including a vertical well casing, the bracelet anode assembly being tightenable around the well casing to advantageously allow for mounting the one or more bracelet anodes at a fixed vertical position on the vertical well casing. Embodiments of the invention also provide a bracelet anode assembly having one or more bracelet anodes that advantageously allow for mounting of the one or more bracelet anodes at a minimal distance from the outer surface of the vertical well casing. The effective distance between the bracelet anodes can be substantially equidistant from the outer circumference of the outer surface of the vertical well casing (e.g., for any circular cross-section of the outer surface of the vertical well casing), which advantageously provides an enhanced ion pathway between the one or more bracelet anodes and all points of the well casing thereby beneficially to decrease the resistance of the cathodic protection circuit and to provide a higher tolerance for non-homogeneity of the backfill.

Embodiments of the present invention beneficially position the anode to be as close as possible to the well casing so that current will discharge most directly from the anode to the cathode, minimizing the ion pathway distance through the electrolyte surrounding both the anode and the cathode. For any given density of pollutants or degree of non-homogeneity in the ion pathway, as can be shown with reference to FIG. 4*b* or FIG. 4*a*, minimizing the distance of the ion pathway through the backfill 104 between the anode and cathode allows the absolute quantity of pollutants in the ion pathway to be reduced. The effectiveness of the enhanced electrochemical cell is thereby operably increased, resulting in a greater degree of cathodic protection provided to the cellar-area well casing 108 so that the cellar-area well casing 108 can be better protected from corrosion.

In other words, minimizing the distance between the anode and the cathode allows the enhanced GACP system to function more effectively in a non-homogenous electrolyte. By minimizing this distance, the resistance through the ion pathway is reduced for any given density of pollutants or degree of non-homogeneity of the electrolyte. Further, the effectiveness of the cathodic protection circuit can be maintained for higher densities of pollutants or higher degrees of non-homogeneity.

Even further, according to embodiments of the invention, the arc-shape of the sacrificial anodes allows for increased surface area of the anode, thereby beneficially decreasing the resistance in the cathodic protection circuit. By way of example, the formulas below such decreased resistance, assuming the use of sweet sand as the backfill 104 (sweet sand can be assumed to have an electrical resistivity of approximately 10,000 ohm-cm in its pure state). As a preliminary matter, those having skill in the art will appreciate that the any backfill 104 can be selected to most advantageously reduce the cost of repairs and work-over due to casing corrosion inside the cellar area or otherwise.

The difference between embodiments of the invention and known off-shore subsea applications of bracelet galvanic anodes becomes immediately apparent, using the McCoy formula as is set forth in equation [1], as the resistance through the electrolyte would be approximately 22.2 ohm for an anode bracelet 30 inches long for a well casing having a 30 inch outer diameter.

$$R = \frac{0.3\rho}{\sqrt{A_S}} \quad [1]$$

ρ (resistivity of electrolyte)=10,000 ohm-cm $A_S$ (anode outer surface area)=18241 $cm^2$ R (anode resistance)=22.212 ohm In contrast, for bracelet anodes of the same size in a subsea environment, the resistance through the seawater would be approximately 0.036 ohm, which can be shown using the McCoy formula as shown in equation [2] and assuming that the seawater has an electrical resistivity of approximately 16 ohm-cm. Accordingly, the anode resistance is approximately 600 times greater in the cellar area, where the electrolyte is one of a backfill soil rather than sea water.

$$R = \frac{0.3\rho}{\sqrt{A_S}} \quad [2]$$

ρ (resistivity of electrolyte)=16 ohm-cm

A (anode outer surface area)=18241 $cm^2$

R (anode resistance)=0.036 ohm

The difference in resistance exhibited in the cellar area and the subsea environment illustrates the different considerations in structuring anodes as bracelets (i.e., being arc shaped and circumferentially surrounding the casing or pipeline) in the cellar environment on the one hand and in the subsea environment on the other hand. In the cellar area, embodiments of the present invention overcome high levels of resistance through the electrolyte for short distances, and the shape and positioning provided by bracelet anodes best overcomes highly resistive electrolytes. In the subsea environment, by contrast, the electrolyte is significantly more conductive and the shape and positioning of the anode as a bracelet is much less significant to the overall resistance of the circuit (due to the much longer lengths of pipeline protected). As is discussed below, a greater consideration in using bracelet anodes in the subsea environment may be for ease of off-site installation, which is irrelevant to cellar area applications.

Turning attention to the cellar area, the difThrence in resistance exhibited by conventional GACP systems and embodiments of the present invention further illustrate the advantages of using bracelet anodes therein. Discrete cylindrical anodes conventionally used in the cellar area, which are assumed to a length of 150 cm and a diameter of 10 cm, for example, would provide a resistance through the electrolyte is approximately 40.15 ohm, as can be shown by Dwight's Equation, as is set forth in Equation [3]:

$$R_V = \frac{0.159\rho}{L} \cdot \left[\ln\frac{8L}{d} - 1\right] \quad [3]$$

ρ (soil resistivity)=10,000 ohm-cm
L (anode length)=150 cm
d (anode diameter)=10 cm
$R_v$ (anode resistance)=40.147 ohms It is evident, therefore, that the overall resistance of the galvanic protection circuit is related to the shape and dimensions of the anode, as well as the resistivity of the electrolyte around it (which is directly proportional to resistivity and inversely proportional to size). A bracelet anode assembly mounted directly to the well casing effectively minimizes the distance between the anode and the cathode and, therefore, minimizes the resistive effect of the electrolyte as a charge carrier. The shape of the bracelet anodes also results in a lower anode resistance compared to pre-packaged cylindrical anodes, which advantageously increases the effectiveness of the GACP system when used in non-homogenous backfill. Accordingly, the type of anode used is less significant in a homogenous electrolyte. The anode resistance provided by standard cylindrical magnesium anodes, for example, reduces the efficiency of conventional GACP systems operating in a non-homogenous electrolyte, such as in cellar-area applications, and has created the need to replace the electrolyte to restore efficiency. Accordingly, embodiments of the present invention eliminate any need to replace the cellar-area backfill once it becomes polluted. Likewise, embodiments of the present invention minimize the risk that such replacement may be necessary in order to ensure adequate cathodic protection is provided to the cellar-area well casing.

Embodiments of the invention further provide enhanced anode assemblies that are uniquely suited for installation on existing well-casing in the cellar area without the need for heightened installation precision or any electrical cable connections. For example, embodiments of the invention provide a means of making a direct electrical connection using a shorting screw, which is uniquely suited for installation on existing well casings in the cellar area.

As can be shown with reference to FIG. 4*c*, FIG. 5*a*, FIG. 5*e* and FIG. 7, an electrical connection between the anode core 501 and 502 and the cellar-area well casing 108 can be established by one or more metallic shorting rods. The metallic shorting rods can be threaded metallic shorting rods, such as, shorting screws, i.e. shorting screw 521 or shorting screw 522. Shorting screws can be, for example, sheet metal screws composed of stainless steel (e.g., 18-8 alloy) or zinc-plated carbon steel (for corrosion protection) having a thread diameter of ¼ inch. Shorting screws 521 and 522 are threaded through the respective anode core 501 or 502 and may also pass through a portion of a respective anode frame 503 or 504, making a direct electrical connection through the shorting screw 521 or 522 between the cellar-area well casing 108 and the anode core 501 or 502 (and, optionally, the anode frame 503 or 504). Embodiments of the present invention provide a direct electrical connection between the anode core and the well casing through a shorting screw, as opposed to a welded cable connection as used in conventional GACP systems, to enhance the efficiency and safety of installing bracelet anodes on existing well casings in the cellar area. The shorting screws beneficially allow, for example, the bracelet anode assembly 400 to be installed, and potentially removed, without the need to weld, or the need to break, any cables. More importantly, using a shorting screw beneficially avoids having to make a thermite weld near an existing wellhead, which could be dangerous due to the presence of volatile or combustible matter in the cellar area. Other types of rigid conductive members can be used as a shorting screw. For example, a lag bolt or a rigid, conductive rod can be inserted through an orifice that passes through anode core 501 or 502 and can also pass through a portion of a respective anode frame 503 or 504.

Making a direct electrical connection through a shorting screw, such as shorting screw 522, is uniquely suited to cellar area applications, where it is critical to ensure that the anode and cathode are electrically connected using the shortest path and the path of least resistance. Making a direct connection using the shorting screws is advantageous because direct physical contact between the anode core 501 or the anode frame 503 (which is directly electrically connected to the anode core) and the well casing 108 does not provide an adequate or reliable electrical connection. For example, there may be gaps and accumulated matter between the anode core 501 or the anode frame 503 and the well casing 108.

Shorting screws are suitable for the cellar area because there, unlike in subsea pipeline applications, current-throw—which is the ability for the anode to throw current outwards to cover a large surface area of the cathode—is not a concern. For bracelet anodes installed on subsea pipelines, however, current-throw concerns can affect the quantity of anodes needed over a certain pipe length. For example, in subsea environments, the bracelet anodes are typically spaced approximately 150 meters apart (intended to protect 75 meters of pipeline in two directions) and they are fully and permanently surrounded with highly conductive seawater. Accordingly, for subsea pipelines, the operative distance of cathodic protection provided by a single bracelet anode is a function of the current demand by the pipe, which is governed by the quality of the coating on the surface of the pipe. In contrast, to cathodically protect well casing in the cellar area, only one bracelet anode assembly is required the remainder of the pipeline outside of the cellar area is protected by an impressed-current cathodic protection system. Current-throw, therefore, is not a concern in the cellar area, and the direct electrical connection provided by shorting screws advantageously reduces the length and the resistance of the electrical path, thereby providing a more effective CP circuit uniquely suited for cellar-area applications.

Even further, using a screw to make a direct electrical connection between the anode and the well casing is particularly advantageous in the cellar area due to the shape of a screw. For example, sand or other solid particles (e.g., dirt, sludge, other pollutants) within the cellar area could, potentially, obstruct an electrical connection to the well casing. In particular, it is likely that such solid particles may accumulate on the well casing or be introduced during installation or the ongoing operation of the bracelet anode assembly. A shorting screw, for example, is beneficially thin in cross-sectional form, which thereby minimizes the surface area presented to make the direct electrical connection to the well casing, and thereby minimizes the risk of such an obstruction. In certain embodiments, the shorting screw can have a pointed tip, which advantageously increases the pressure that can be applied by the screw on contact with the well casing, thereby operably displacing or penetrating accumulation of foreign matter. Accordingly, using a shorting screw in embodiments of the present invention minimizes the likelihood of such an obstruction being an issue during the installation and operation of the bracelet anode assembly. Furthermore, the portion of the threaded shaft of the screw positioned within the anode core can beneficially increase the contact surface with the anode core to overcome accumulation of foreign matter (including any solid particles introduced to or present in the threaded holes of the anode core).

Even further still, the use of a shorting screw advantageously imposes minimal structural requirements for the bracelet anode to receive the shorting screw. The only structural requirement to accept the shorting screw is that the anode core and, optionally, the anode frame be drilled and tapped to receive the shorting screw. Such minimal structural requirements advantageously allows conventional equipment (e.g., the anode frames themselves as well as any molds, presses, jigs used in constructing the bracelet anodes) that is conventionally used for subsea pipelines to be used also to construct the anode core and the anode frame for the bracelet anode assembly.

Even further yet, the advantages of using a shorting screw to make a direct electrical connection between the anode core and the well casing include the low cost and the ease of replacing a shorting screw in the event that the shorting screw fails. Advantageously, the shorting screws should be readily available, and the shorting screw provides a single, integral component both to make the electrical connection (metal composition) and to secure the connection (threads and screw head).

Figure 7:
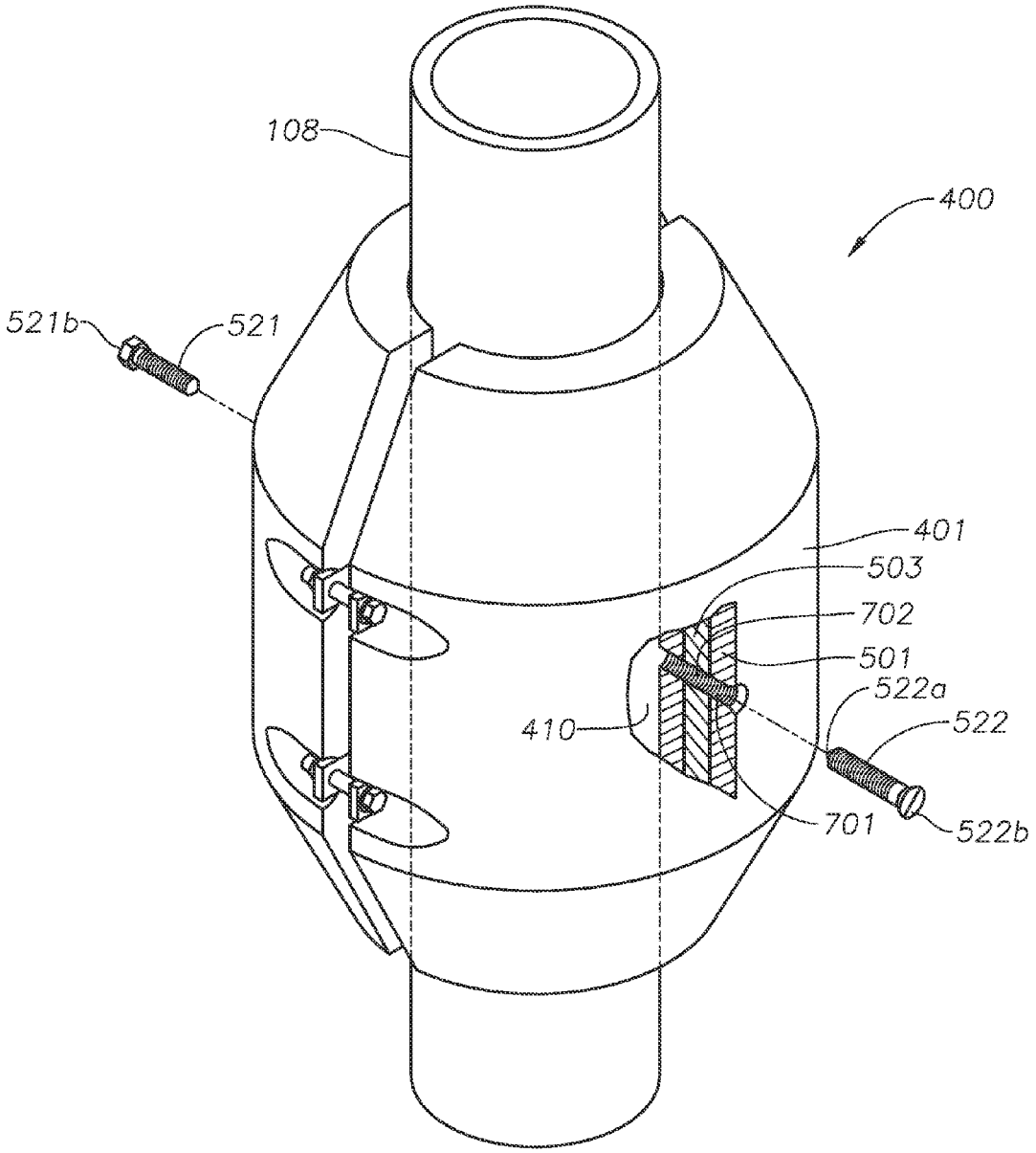
FIG. 7 is an isometric cross section drawing of the shorting screw, bracelet anode, anode frame, and cellar-area well casing according to embodiments of the invention.

According to an exemplary embodiment, shorting screws 521 and 522 are provided as shown in FIG. 5*a*, and a more detailed view of shorting screw 522 can be shown with reference to FIG. 7. Shorting screw 522, for example, can be operably positioned through the anode core 501, particularly through a threaded hole 701 in the anode core 501, and also through the anode frame 503, particularly through a threaded hole 702 in the anode frame 503, which can be either threaded or unthreaded. The shorting screw 522 can be tightened as necessary so that the tip 522*a* of the shorting screw 522 makes direct electrical contact with the cylindrical subsection surface 410 of the well casing 108. The tip 522*a* of the shorting screw can be flat or pointed, as is illustrated in FIG. 5*a*. Embodiments of the invention having a shorting screw with a pointed tip advantageously ensure an effective and persistent electrical connection between the bracelet anode 401 and the well casing 108, for example, by overcoming accumulated dirt, oxidation, or other foreign matter that could otherwise increase the resistance, obstruct, or otherwise insulate the direct electrical connection. The head 522*b* of the shorting screw 522 can be a countersunk head, for example, to allow the head 522*b* to contact the anode core 501 at a greater surface area for the purpose of making more effective electrical contact with the anode core 501. In other embodiments, such as that shown by shorting screw 521 in FIG. 5*a*, the shorting screw can be a bolt and the head 521*b* can be a standard bolt head.

Accordingly, in embodiments of the invention comprising shorting screws, such as shoring screw 522, the electron flow in the galvanic cathodic protection circuit can be shown with reference to FIG. 4*c*. In the embodiment or embodiments illustrated in FIG. 4*c*, electrons, such as electrons 4001 and 4002, can flow in a path 4000*a*-4000*b* from the anode core 501 to the shorting screw in direct electrical contact with the anode core 501, such as shorting screw 522, as is shown with reference to electrons 4011 on the shorting screw 522. Also, as can be shown with reference to FIG. 4*c*, electrons, such as electrons 4001 and 4002, can flow in a path 4000*g*-4000*h* from the anode core 501 to the metallic anode frame 503 as is shown with reference to electrons 4021 and 4022 on the metallic anode frame 503. Further, electrons, such as electrons 4011, can flow through a path 4000*e*-4000*f* through the metallic shorting screw 522, which is in direct electrical contact with the outer surface of the well casing 108, to the well casing 108, as can be shown with reference to electrons 4031 and 4032 on the surface of the well casing 108. Likewise, electrons, such as electrons 4021 and 4022, can flow through a path 4000*c*-4000*d* through the metallic anode frame 503 and the metallic shorting screw 522, which is in direct electrical contact both the metallic anode frame 503 and the outer surface of the well casing 108, to the well casing 108, as can be shown with reference to electrons 4031 and 4032 on the surface of the well casing 108.

In certain embodiments, such as for water wells, the bracelet anodes may also be electrically connected to the cellar-area well casing 108 using a cable connection as a fail-over. As can be shown in FIG. 4*a*, cable connection 408 serves as a continuity backup to the shorting screw, such as that shown in FIG. 4*c* and FIG. 5*a*, for the purpose of making an electrical connection between the well casing and the anodes. Cable connection 408, for example, may be attached on one end of the anode frame 503 or 504 (best shown in FIG. 5*b*) using an attachment screw or a weld (not pictured) attached directly to the anode frame, such as at the bracket 503*a*. Cable connection 408, for example, may be attached at the other end to the well casing using a weld (not pictured), for example, at the well head 102. Welded cable connections can be, for example, thermite welded to the well head 102 below the lower well head bracket, to provide a suitable electrical connection between the anode and cathode and to thereby avoid disconnection of the CP system during work-over. In other embodiments, such as for oil the cable connection 408 can be eliminated, relying solely on shorting screw for safety reasons, such as to avoid welding near volatile or combustible materials.

Embodiments of the present invention also include methods for installing the bracelet anodes 401 and 402 that are distinguished from conventional methods, for example, with respect to installing conventional bracelet anodes on subsea pipelines. For subsea pipelines, for example, bracelet anodes are conventionally mounted around a pipeline joint in a workshop, before the greater pipeline is installed in the sea. For subsea pipelines, conventional bracelet anodes are installed over insulation and are electrically connected to the pipeline by a cable connection. The anode cable is welded and tested in the workshop, and the finished product is a protected pipeline assembly including the pipeline joint, the anodes, and the anode cable. Conventional pipeline anodes are typically spaced on the pipeline so there is one anode assembly at every tenth pipe joint. The protected pipeline assembly is then transported to the installation location on an installation barge, where multiple pipeline joints, including one or more protected pipeline assemblies, are welded together to form a pipeline chain, which is then lowered into the water as a chain.

According to embodiments of the present invention, bracelet anodes 401 and 402 are installed on a pre-existing well casing in the cellar area and are not installed on the well-casing prior to installation at the well site. Installation is performed by first removing existing backfill 104 from the cellar area so that the bracelet anodes 401 and 402 can be positioned around the cellar area well casing 108 at a location of the cellar-area, well casing where corrosion is most persistent. The bottom of the enclosed section 108 of the well casing 106 is, for example, is where the presence of water is typically most persistent and where corrosion is often most severe. Embodiments of the present invention do not require removal of any cement from surrounding the well casing 106. Absent embodiments of present invention, the cement surrounding the cellar-area well casing 108 and shielding the ICCP ionic current 200 from the conventional deep anode bed 202 disadvantageously leaves bare metallic well casing in the cellar area 100 unprotected. One known solution has been to remove cement to reduce or eliminate the shielding effect. Using embodiments of the present invention, however, the disadvantage is overcome because adequate localized protection can provided within the cellar area. Embodiments of the present invention therefor eliminate the need to remove cement, which can pose safety hazards for personnel operating in the cellar. Those having skill in the art will appreciate, however, that partial removal of cement may be desirable, for example, to facilitate installation of the bracelet anodes 401 and 402 at the bottom of the enclosed section 108 of the well casing 106.

Removal and replacement of backfill 104 for existing well casings is critical due to the likely presence in the backfill 104 of pollutants, such as cement rubble remaining after the cementing job in drilling the well. Cement rubble, for example, may contain numerous cavities, thereby impeding the flow of ions in the cathodic protection system. Because pollutants in the backfill 104 are, generally, not conductive, and because the size, distribution, or composition of the pollutants in the backfill 104 cannot known with certainty, replacement of the backfill to remove the pollutants advantageously allows the conductivity of the backfill, and the effectiveness of the GACP system, to be provided with greater certainty. After the installation of the bracelet anodes 401 and 402, which is described further herein, the backfill 104 can be replaced with sweet sand, for example, having no more salt content than 0.1% by weight and no more free-moisture content than 2.0% by weight (for example, the sweet sand shall be dried in preparation and screened through 2 mm mesh and handled to ensure mixture remains free from foreign matter). Using sweet sand as the backfill advantageously reduces the cost of repair and work-over due to casing corrosion inside the cellar area or otherwise. Even properly prepared and handled sweet sand, however, can become polluted over time; and embodiments of the present invention advantageously allow efficient, localized cathodic protection to the well casing in such a circumstance.

The bracelet anodes 401 and 402 can be mounted directly on the bare well casing, without any insulation between the anode and the well casing. One bracelet anode assembly 400 is sufficient to protect a single cellar-area well casing section. To install the bracelet anode assembly, a field operator performs the following steps: (i) excavate a half meter deep and half a meter wide "donut hole" around the well casing at the cellar area, for example, using a shovel; (ii) fix and clamp the two halves of the bracelet anode to circumferentially surround the well casing at an area of the well casing most susceptible to corrosion this area will receive the strongest degree of cathodic protection, but cathodic protection will protect the entire length (approximately 2 meters) of the well casing section within the cellar area and surrounded by the backfill electrolyte; (iii) tighten the bolts to an appropriate torque, as described herein and as will be appreciated by those having skill in the art, in accordance with the bolt size, as shall be governed by the well casing outer diameter and the corresponding anode size; (iv) tighten the shorting screws (e.g., one for each bracelet anode, and two for the entire bracelet anode assembly) to make the direct electrical connection (i.e., a short) from the anode to the cathode; (v) add backfill to the excavated area around the anode using sweet sand as described herein; (vi) moisten the area around the anode using 10 liters of distilled water; (vii) test the potential of the anode and the cathode, independently, using a Cu—CuSO4 reference electrode and report/confirm the readings as described herein. Accordingly, the compressive force provided by the tightening of the bracelet anode assembly around the well casing can clamp the bracelet anode assembly at a fixed vertical position on the cellar-area well casing 108. Fasteners 507*a-b* and 509*a-b*, having been tightened, thereby secure the vertical position of bracelet anodes assembly 400 on the cellar-area well casing 108, and shorting screws, such as shorting screws 521 or 522, provide the primary electrical connection between the anode core 501 and 502 and the cellar-area well casing 108.

In further detail, it is notable that precision is not critical in positioning and installing the bracelet anodes 401 and 402, provided that the bracelet anodes 401 and 402 are positioned substantially near the bottom of the cellar-area well casing 108 where corrosion is most likely. Installation precision is not essential because the existing well casing 106 is already in place, and there is no risk of movement by the well casing 106 that could cause the bracelet anodes 401 and 402 to slip or to be jarred from the well casing, as is often the case for pre-installed bracelet anodes on subsea pipeline joints as they are laid into the sea. The application of bracelet anodes in the cellar area advantageously lacks precision mounting requirements, for example, as the application can tolerate gaps between the anode assembly and the well casing due to the generally static nature of materials and operations in the cellar area. Bracelet anodes installed on subsea pipelines, however, require highly precise mounting, as any gaps between the anode assembly and the pipeline could allow sliding of the anode when the pipeline assembly chain (including the anodes that are pre-installed) is lowered to the sea floor. Any sliding of the anode in subsea environments could be detrimental, for example, as the anode itself could be damaged or the cable connection could snap. Further, in embodiments of the present invention, any gap between the anode assembly and the well casing or any sliding of the anode assembly is tolerable because the shorting screws ensure a direct electrical connection regardless of the position of the bracelet anode along the length of the casing in the cellar area. The shorting screws, being readily removable, also allow the bracelet anode to be efficiently removed for periodic maintenance or anode replacement, avoiding the need to break or re-weld any cables. More importantly, the shorting screws beneficially allow avoiding a thermite weld near the wellhead, which could be dangerous due to the presence of combustible materials. Accordingly, subsea installation of conventional bracelet anodes on pipelines is a dynamic process that raises concerns different than those faced in the cellar area. In the cellar area, for example, the primary concerns in installation are efficiency and safety of on-site installation on static, existing well production operations.

According to embodiments of the present invention, the operation of an enhanced galvanic anode cathodic protection system is not critically dependant on the homogeneity of the electrolyte in the backfill 104 of the cellar area 100, and therefore, there is no need to periodically refurbish, restore, replace, or refresh the electrolyte in the cellar-area backfill. Because embodiments of the present invention position the anode assembly directly (physically) on the well casing, any variance in conductivity of the cellar-area electrolyte is insignificant, and does not affect the operation of the protective electrochemical cell. Furthermore, according to embodiments of the invention, enhanced cathodic protection of the enclosed section 108 of an existing well casing 106 can be provided using only one bracelet anode assembly for each well casing 106, as can be shown with reference to FIG. 4*a*, even where cement behind the casing at the cellar area and surrounding the well casing 106 has not been removed and where the enclosed section of the well casing 108 has not been coated.

Figure 6:
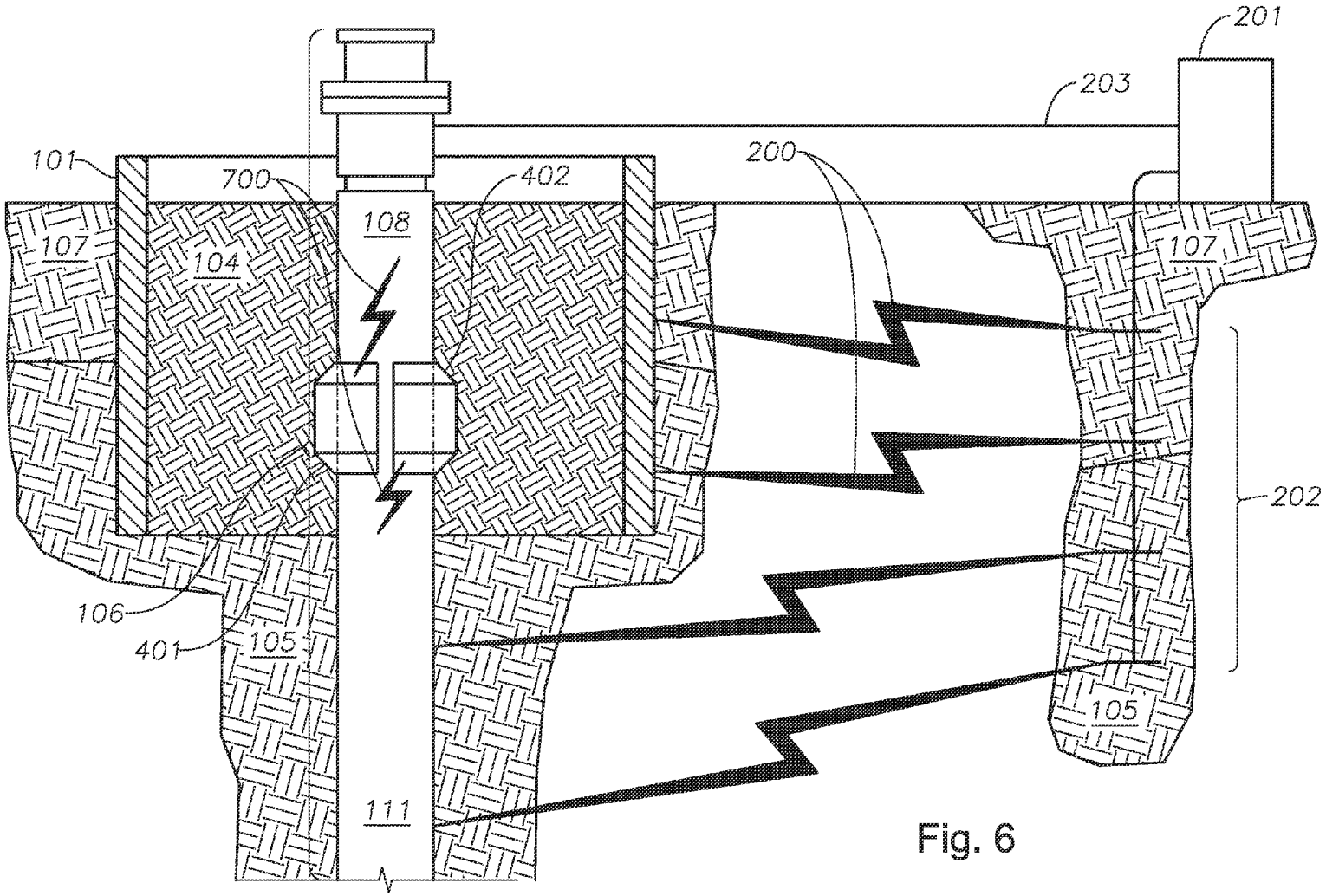
FIG. 6 is a schematic elevation cross-section of a subterranean well casing, a cellar area of a well, a known impressed current cathodic protection system to protect a section of the well casing outside the cellar area of the well, and the enhanced galvanic anode cathodic protection system of FIG. 5*a*, according to an embodiment of the present invention, to protect a section of the well casing inside the cellar area of the well.

An enhanced cathodic protection system and method to provide cathodic protection to a well casing, according to embodiments of the invention, can be shown with reference to FIG. 6. The method includes providing a primary cathodic protection circuit and a secondary or supplemental cathodic protection circuit to the well casing 106. The well casing 106, which is positioned below the earth surface 107, can be divided, conceptually, into two sections: an upper enclosed section 108, which is enclosed by a cellar ring 101, and a lower unenclosed section 111, which is below the cellar area 100 and not enclosed by the cellar ring 101.

The primary cathodic protection circuit is provided by an impressed-current cathodic protection system, which includes a power source 201, a deep anode bed 202, the unenclosed section 111 (as the cathode), and an electrolyte in the earth medium 105 that provides one or more ion pathways between the deep anode bed 202 and the unenclosed lower section 111 of the well casing 106. The primary cathodic protection circuit includes transmitted ion current 200 through the ion pathway in the electrolyte in the earth medium 105, which, in part, surrounds the unenclosed lower section 111 of the well casing and, in part, the deep anode bed 202. The primary cathodic protection circuit also includes transmitted electron current through an electrical connection, such as the wire 203, between the power source 201 and the well casing 106. The primary cathodic protection circuit is provided, therefore, as a first line of defense against casing corrosion for the entire well casing 106, despite acknowledged disadvantages in the cellar area caused by the cellar ring 101.

The secondary cathodic protection circuit is provided by a galvanic anode cathodic protection system, in particular, to overcome the disadvantages caused by the cellar ring 101. The secondary cathodic protection circuit includes bracelet anodes 401 and 402, the enclosed upper section 108 of the well casing, and an electrolyte in cellar backfill 104 present in the cellar 100. The electrolyte in the cellar backfill 104 provides one or more ion pathways 700 between the bracelet anodes 401, 402 and the enclosed section 108 of the well casing 106 through the electrolyte in the cellar backfill 104. The secondary cathodic protection system transmits ion current 700 through the cellar backfill between the well casing 108 and the bracelet anodes 401, 402 and transmits electron current through the shorting screw 522 (as can be shown with reference to FIG. 5*a* and FIG. 5*e*, for example) between the anode core 501, 502 and the enclosed upper section 108 of the well casing 106. The secondary cathodic protection circuit is provided, therefore, as a supplemental line of defense against well casing corrosion, specifically with respect to the part of the well casing in the cellar area that is not sufficiently protected by the primary cathodic protection circuit.

The secondary cathodic protection circuit differs from conventional galvanic anode CP provided for subsea pipelines in that the entire well casing is also protected by the primary cathodic protection circuit. Accordingly, the secondary cathodic protection circuit is not intended to provide protection to the entire well casing or even to a substantial length of well casing (in most cases, the length of the cellar-area well casing to be protected is approximately 2 meters or less). Because the secondary cathodic protection circuit is intended only to provide protection to the part of the well casing within the cellar area, the shape, structure, mounting assembly, and installation procedure can be simplified and/or enhanced specifically for cellar-area applications. The secondary cathodic protection circuit is further enhanced, for cellar area applications, over bracelet galvanic anode systems in subsea environments, for example, by incorporating a shorting screw to improve the efficiency and safety of installing the galvanic anode assembly on existing well casings, i.e., well casings installed and in operation as well as to improve the efficiency and safety of ongoing operations. In the cellar environment, a shorting screw can provide a direct electrical connection to the cathode that is simpler, more efficient, and safer to install and uninstall than alternative means of electrical connection, such as a welded cable. Likewise, disadvantages of using a shorting screw in subsea environments, such as the potential for installation breakage or reduction of current-throw, are not encountered in the cellar environment. The use of a shorting screw, furthermore, also distinguishes embodiments of the invention over the conventional use of galvanic anode CP in the cellar area, which, for example, employ discrete anodes not directly mounted to the pipeline. Moreover, the secondary cathodic protection circuit differs from conventional galvanic anode CP provided in the cellar environment in that an anode assembly is provided which can be mounted directly on the well casing to minimize the distance of the ion pathway between the anodes and the cathode. Minimizing the distance of the ion pathway, and thereby reducing the resistance thereof, advantageously increases the tolerance of the enhanced galvanic anode CP system to non-homogeneity in the backfill. Accordingly, for any shorter distance of the ion pathway, the enhanced galvanic anode CP system can tolerate greater resistivity of the backfill, for example, as a result of increased non-homogeneity.

In exemplary embodiments, the expected lifespan of the anode core is approximately five (5) years. Monitoring the performance, and therefore, life expectancy, of the anodes can be accomplished by taking pipe-to-soil potential measurements using a Cu—CuSO4 reference electrode placed in the soil. The anode core, according to embodiments of the invention, is not expected to encounter drastic changes in its current output during operation absent any drastic change in the operating environment. Examples of such drastic environmental changes include, for example, the soil around the casing being replaced with a very conductive/corrosive soil. In such a circumstance, the anode core would be expected to discharge more current and, hence, have a shorter lifespan. Absent any drastic changes, the anode is expected to have a relatively linear consumption rate over most of its operating life. Changes in the temperature of the fluid inside the casing, for example, are unlikely to significantly affect the anode consumption. Operatively, the anode is expected to undergo a fast polarization with a higher consumption rate over an initial period shortly after installation, and then the anode current output is expected to reach an equilibrium in which the anode current remains linear over the life of the anode material.

In the drawings and specification, there have been disclosed a typical preferred embodiment of the invention, and although specific terms are employed, the terms are used in a descriptive sense only and not for purposes of limitation; for example, words related to numbering used herein—such as "primary," "secondary," "first," "second," "third" or other ordinal numbers—are merely descriptive and do not define or connote an order, sequence, or degree of importance. The invention has been described in considerable detail with specific reference to these illustrated embodiments. It will be apparent, however, that various modifications and changes can be made within the spirit and scope of the invention as described in the foregoing specification and as defined in the appended claims.

The invention claimed is:

1. A bracelet anode assembly to provide enhanced cathodic protection to one or more vertical well casing sections in a cellar area, the cellar area being bounded by a cellar ring and being partially filled with a backfill containing an electrolytic composition surrounding the one or more vertical well casing sections, the one or more vertical well casing sections in the cellar area defining a cellar-area well casing, the bracelet anode assembly comprising:

a plurality of arc-shaped bracelet anodes adapted to circumferentially surround a cylindrical subsection of an outer surface of the cellar-area well casing such that the plurality of arc-shaped bracelet anodes being operable to be mechanically connected in a substantially circular tightenable bracelet form that, when tightened, is operable to clamp the plurality of arc-shaped bracelet anodes to a fixed vertical position on the cylindrical subsection of the outer surface of the cellar-area well casing, each respective arc-shaped bracelet anode of the plurality of arc-shaped bracelet anodes comprising:

an arc-shaped anode frame to provide mechanical support to the respective arc-shaped bracelet anode, the arc-shaped anode frame being a separately formed support structure and having one or more brackets at each distal end to allow a mechanical connection to be made to one or more brackets of adjacent arc-shaped bracelet anodes in the substantially circular tightenable bracelet form, an arc-shaped anode core connected to the arc-shaped anode frame such that the arc-shaped anode frame is substantially embedded within the arc-shaped anode core, to allow a surface of the arc-shaped anode core to substantially circumferentially surround the cylindrical subsection of the outer surface of the cellar-area well casing to operably provide an ion pathway through the electrolytic composition between the surface of the arc-shaped anode core and the outer surface of the cellar-area well casing, the arc-shaped anode core defining an anode orifice therein;

a plurality of connectors to mechanically connect each of the plurality of arc-shaped bracelet anodes to the one or more adjacent arc-shaped bracelet anodes in the substantially circular tightenable bracelet form, each of the plurality of connectors adaptable to be connected to the bracket at one of the distal ends of the arc-shaped anode frame of the respective arc-shaped bracelet anode and further connected to the bracket of one of the distal ends of the arc-shaped anode frame of the one or more adjacent arc-shaped bracelet anodes, thereby allowing the substantially circular tightenable bracelet form to be operably tightened by force applied to the plurality of connectors;

one or more metallic shorting rods, each of the one or more metallic shorting rods to be positioned through the anode orifice of a respective arc-shaped anode core for each of the plurality of arc-shaped bracelet anodes so that the respective metallic shorting rod is operable to contact the outer surface of the cellar-area well casing, each of the plurality of metallic shorting rods thereby being operable to be in direct electrical contact with the respective arc-shaped anode core such that each of the one or more metallic shorting rods is operable to complete an electrical connection between the respective arc-shaped anode core and the outer surface of the cellar-area well casing to provide an electron pathway between the respective arc-shaped anode core and the outer surface of the cellar-area well casing, the electron pathway and the ion pathway completing an enhanced galvanic anode cathodic protection circuit.

2. A bracelet anode assembly as defined in claim 1, wherein:

the arc-shaped anode frame comprises a frame orifice therein that substantially aligns with the anode orifice;

each of the plurality of metallic shorting rods being further operable to be positioned through the frame orifice of a respective arc-shaped anode frame for each of the plurality of arc-shaped bracelet anodes, each of the plurality of metallic shorting rods thereby being in direct electrical contact with the respective arc-shaped anode frame; and the electrical connection between the respective arc-shaped anode core and the outer surface of the cellar-area well casing further comprises:

a first electrical connection between the respective arc-shaped anode core and the respective arc-shaped anode frame, and a second electrical connection between the respective metallic shorting rod and the respective arc-shaped anode frame.

3. A bracelet anode assembly as defined in claim 2, wherein one or more of the anode orifice and the frame orifice are threaded and each of the one or more metallic shorting rods is a screw.

4. A bracelet anode assembly as defined in claim 1, wherein:

the plurality of arc-shaped bracelet anodes comprises exactly two substantially semicircular bracelet anodes to define a first substantially semicircular bracelet anode and a second substantially semicircular bracelet anode, the arc-shaped anode frame of the first substantially semicircular bracelet anode defining a first substantially semicircular anode frame and the arc-shaped anode frame of the second substantially semicircular bracelet anode defining a second substantially semicircular anode frame, each of the two substantially semicircular bracelet anodes being adapted to be positioned horizontally opposed such that the two substantially semicircular bracelet anodes are operable to substantially circumferentially surround the cylindrical subsection of the outer surface of the cellar area well casing;

the substantially semicircular anode frame for the first substantially semicircular bracelet anode and the substantially semicircular anode frame for the second substantially semicircular bracelet anode including exactly two brackets at each distal end thereof, each bracket projecting outward therefrom at a substantially normal angle thereto; and the plurality of connectors comprises exactly four fasteners, each of the exactly four fasteners corresponding to a respective bracket on the first substantially semicircular anode frame and a respective bracket on the second substantially semicircular anode frame.

5. A bracelet anode assembly as defined in claim 1, wherein:

the electrolytic composition has a resistivity being greater than sea water;

the cellar-area well casing has a vertical length dimension being less than two (2) meters; and the ion pathway between the surface of the arc-shaped anode core and the outer surface of the cellar-area well casing being operable to provide enhanced cathodic protection to the outer surface of the cellar-area well casing in its entirety through the electrolytic composition.

6. A bracelet anode assembly as defined in claim 1, wherein:

the electrolytic composition within the cellar area is a non-homogenous electrolytic composition; and the ion pathway is an enhanced ion pathway having an effective path length substantially equivalent for any point along any cross-sectional circle along the outer surface of the cellar area well casing, providing an enhanced overall resistance being less than that which could be provided by pre-packaged cylindrical anodes being positioned within the non-homogenous electrolytic composition.

7. A bracelet anode assembly as defined in claim 1, wherein the cellar-area well casing has an outer surface that is uncoated bare metal.

8. A bracelet anode assembly as defined in claim 1, wherein the metallic shorting rod is a screw having a pointed tip.

9. A bracelet anode assembly as defined in claim 1, wherein the one or more vertical well casing sections are for a water well, and wherein the bracelet anode assembly further comprises a cable connection electrically connected to at least one arc-shaped anode frame and a well head of the water well.

10. A bracelet anode assembly as defined in claim 1, wherein the arc-shaped anode core is integrally connected to the arc-shaped anode frame.

11. A bracelet anode assembly as defined in claim 7, wherein each of the plurality of arc-shaped bracelet anodes has an inner anode surface that is uncoated and in direct contact with the outer surface of the cellar-area well casing, the inner diameter of the inner anode surface having a radius that substantially matches a radius of the outer surface of the cellar-area well casing.

12. A bracelet anode assembly as defined in claim 7, wherein each of the plurality of arc-shaped bracelet anodes has an inner anode surface that is uncoated and in direct contact with the electrolytic composition, the electrolytic composition being in direct contact with the outer surface of the cellar-area well casing.

* * * * *